US011308889B2

(12) United States Patent
Song et al.

(10) Patent No.: US 11,308,889 B2
(45) Date of Patent: Apr. 19, 2022

(54) DETECTION METHOD OF PIXEL CIRCUIT, DRIVING METHOD OF DISPLAY PANEL, AND DISPLAY DEVICE

(71) Applicant: BOE TECHNOLOGY GROUP CO., LTD., Beijing (CN)

(72) Inventors: Danna Song, Beijing (CN); Yi Cheng Lin, Beijing (CN); Pan Xu, Beijing (CN); Zhongyuan Wu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 533 days.

(21) Appl. No.: 16/329,352

(22) PCT Filed: Aug. 24, 2018

(86) PCT No.: PCT/CN2018/102260
§ 371 (c)(1),
(2) Date: Feb. 28, 2019

(87) PCT Pub. No.: WO2019/076134
PCT Pub. Date: Apr. 25, 2019

(65) Prior Publication Data

US 2021/0335278 A1 Oct. 28, 2021

(30) Foreign Application Priority Data

Oct. 20, 2017 (CN) ..... 201710984042.7

(51) Int. Cl.
*G09G 3/3291* (2016.01)
*G09G 3/3258* (2016.01)
*G09G 3/00* (2006.01)

(52) U.S. Cl.
CPC ..... *G09G 3/3291* (2013.01); *G09G 3/00* (2013.01); *G09G 3/006* (2013.01); *G09G 3/3258* (2013.01)

(58) Field of Classification Search
CPC ..... G09G 3/3291; G09G 3/006; G09G 3/3258
See application file for complete search history.

(56) References Cited

U.S. PATENT DOCUMENTS

| | | | | |
|---|---|---|---|---|
| 9,754,536 | B2 * | 9/2017 | Chang | G09G 3/3233 |
| 10,522,081 | B2 * | 12/2019 | Kim | G09G 3/2092 |
| 2017/0004764 | A1 * | 1/2017 | Kim | G09G 3/3233 |

FOREIGN PATENT DOCUMENTS

| | | |
|---|---|---|
| EP | 2960894 A1 | 12/2015 |
| EP | 2983165 A1 | 2/2016 |
| EP | 3113163 A1 | 1/2017 |

OTHER PUBLICATIONS

Extended European Search Report in European Patent Application No. 18849456.1 dated Jul. 20, 2021.

* cited by examiner

*Primary Examiner* — Sardis F Azongha
(74) *Attorney, Agent, or Firm* — Collard & Roe, P.C.

(57) ABSTRACT

A detection method of a pixel circuit, a driving method of a display panel, and a display device are disclosed. The pixel circuit includes a driving transistor; and the detection method of the pixel circuit includes: in the first charge cycle, applying a first data voltage to a gate electrode of the driving transistor, acquiring a first sensing voltage at a first electrode of the driving transistor within the first duration after the application of the first data voltage and before the driving transistor is switched off, and determining whether the first sensing voltage is equal to reference sensing voltage.

19 Claims, 12 Drawing Sheets

DETECTION METHOD OF PIXEL CIRCUIT, DRIVING METHOD OF DISPLAY PANEL, AND DISPLAY DEVICE

CROSS REFERENCE TO RELATED APPLICATIONS

This application is the National Stage of PCT/CN2018/102260 filed on Aug. 24, 2018, which claims priority under 35 U.S.C. § 119 of Chinese Application No. 201710984042.7 filed on Oct. 20, 2017, the disclosure of which is incorporated by reference.

TECHNICAL FIELD

Embodiments of the present disclosure relate to a detection method of a pixel circuit, a driving method of a display panel, and a display device.

BACKGROUND

Organic Light Emitting Diode (OLED) display panels have gradually attracted the attention of people due to wide viewing angle, high contrast, fast response, and advantages such as higher luminance, lower driving voltage and the like over inorganic light emitting diode display devices. Because of the above-mentioned characteristics, the organic light emitting diode (OLED) display panels may be applied into mobile phones, displays, laptops, digital cameras, instruments, and devices with display functions.

SUMMARY

At least an embodiment of the present disclosure provides a detection method of a pixel circuit, wherein the pixel circuit includes a driving transistor; and the method comprises: in a first charge cycle, applying a first data voltage to a gate electrode of the driving transistor, acquiring a first sensing voltage at a first electrode of the driving transistor within a first duration after application of the first data voltage and before the driving transistor is switched off, and determining whether the first sensing voltage is equal to a reference sensing voltage, in which the reference sensing voltage is acquired in a reference charge cycle; in the reference charge cycle, the reference sensing voltage is acquired at the first electrode of the driving transistor within the first duration after application of the reference data voltage to the gate electrode of the driving transistor and before the driving transistor is switched off; and the first data voltage is equal to the reference data voltage.

For example, in the detection method according to at least an embodiment of the present disclosure, in a case where the first sensing voltage is unequal to the reference sensing voltage, in a second charge cycle, a second data voltage is applied to the gate electrode of the driving transistor, and a second sensing voltage is acquired at the first electrode of the driving transistor within the first duration after application of the second data voltage, in which the second data voltage is selected so that a difference between the second sensing voltage and the reference sensing voltage can be less than a difference between the first sensing voltage and the reference sensing voltage.

For example, in the detection method according to at least an embodiment of the present disclosure, in a case where the first sensing voltage is less than the reference sensing voltage, the second data voltage is greater than the first data voltage; and in a case where the first sensing voltage is greater than the reference sensing voltage, the second data voltage is less than the first data voltage.

For example, in the detection method according to at least an embodiment of the present disclosure, in a case where the second sensing voltage is still unequal to the reference sensing voltage, the second charge cycle is repeated until the second sensing voltage is equal to the reference sensing voltage.

For example, in the detection method according to at least an embodiment of the present disclosure, the reference charge cycle is in a shutdown state, and the first charge cycle is in a followed boot-up process after the reference charge cycle; or the reference charge cycle is in a boot-up state, and the first charge cycle is in a boot-up process after the reference charge cycle.

For example, in the detection method according to at least an embodiment of the present disclosure, the first charge cycle and/or the second charge cycle is between display circles.

For example, in the detection method according to at least an embodiment of the present disclosure, the detection method further comprises: acquiring a reference threshold voltage of the driving transistor; and in a case where the first sensing voltage is equal to the reference sensing voltage, acquiring a present threshold voltage of the driving transistor, based on the reference threshold voltage, the first data voltage and the reference data voltage, in which the present threshold voltage of the driving transistor is equal to the reference threshold voltage plus a difference between the first data voltage and the reference data voltage.

For example, in the detection method according to at least an embodiment of the present disclosure, the detection method further comprises: acquiring a reference threshold voltage of the driving transistor; and in a case where the second sensing voltage is equal to the reference sensing voltage, acquiring a present threshold voltage of the driving transistor, based on the reference threshold voltage, the second data voltage and the reference data voltage, in which the present threshold voltage of the driving transistor is equal to the reference threshold voltage plus a difference between the second data voltage and the reference data voltage.

For example, in the detection method according to at least an embodiment of the present disclosure, the step of acquiring the reference threshold voltage of the driving transistor includes: in a shutdown charge cycle of the shutdown state, applying a shutdown data voltage to the gate electrode of the driving transistor, and acquiring a shutdown sensing voltage at the first electrode of the driving transistor after the driving transistor is switched off, in which the reference threshold voltage of the driving transistor is equal to the difference between the shutdown data voltage and the shutdown sensing voltage.

For example, in the detection method according to at least an embodiment of the present disclosure, the shutdown charge cycle is the same as the reference charge cycle, and the shutdown data voltage is equal to the reference data voltage.

At least an embodiment of the present disclosure provides a driving method of a display panel, wherein the display panel includes a pixel circuit; and the driving method comprises: acquiring a present threshold voltage of the driving transistor of the pixel circuit by executing the detection method of the pixel circuit according to any one embodiment of the present disclosure on the pixel circuit.

For example, in the driving method according to at least an embodiment of the present disclosure, the driving method further comprises: creating a compensation factor for the pixel circuit according to the acquired present threshold voltage.

At least an embodiment of the present disclosure provides a display device, comprising a pixel circuit and a control circuit, wherein the pixel circuit includes a driving transistor; and the control circuit is configured to execute a detection method comprising: in a first charge cycle, applying a first data voltage to a gate electrode of the driving transistor, acquiring a first sensing voltage at a first electrode of the driving transistor within a first duration after application of the first data voltage and before the driving transistor is switched off, and determining whether the first sensing voltage is equal to the reference sensing voltage, in which the reference sensing voltage is acquired in a reference charge cycle; in the reference charge cycle, the reference sensing voltage is acquired at the first electrode of the driving transistor within the first duration after the application of the reference data voltage to the gate electrode of the driving transistor and before the driving transistor is switched off; and the first data voltage is equal to the reference data voltage.

For example, in the display device according to at least an embodiment of the present disclosure, the display device further comprises a data drive circuit and a detection circuit, wherein the data drive circuit is configured to output the first data voltage and the reference data voltage; the pixel circuit is further configured to receive the first data voltage and the reference data voltage and apply the first data voltage and the reference data voltage to the gate electrode of the driving transistor; the detection circuit is configured to read the first sensing voltage and the reference sensing voltage from the first electrode of the driving transistor; and the control circuit is further configured to control the data drive circuit and the detection circuit.

For example, in the display device according to at least an embodiment of the present disclosure, the pixel circuit further includes a light-emitting element and a sensing switching transistor; a second electrode and the first electrode of the driving transistor are respectively connected to a first supply voltage terminal and a first electrode of the light-emitting element; a second electrode of the light-emitting element is connected to a second supply voltage terminal; a first electrode of the sensing switching transistor is electrically connected with the first electrode of the driving transistor; and a second electrode of the sensing switching transistor is electrically connected with the detection circuit.

For example, in the display device according to at least an embodiment of the present disclosure, the pixel circuit further includes a sensing line; and a second electrode of the sensing switching transistor is electrically connected with the detection circuit through the sensing line.

For example, in the display device according to at least an embodiment of the present disclosure, the pixel circuit further includes a data write transistor and a storage capacitor; the data write transistor is configured to acquire data signals from the data drive circuit and write the data signals into the gate electrode of the driving transistor; and the storage capacitor is configured to store the data signals.

For example, in the display device according to at least an embodiment of the present disclosure, the control circuit includes a processor and a memory; the memory includes executable codes; and the processor runs the executable codes so as to execute the detection method.

BRIEF DESCRIPTION OF THE DRAWINGS

In order to clearly illustrate the technical solution of the embodiments of the disclosure, the drawings of the embodiments will be briefly described in the following; it is obvious that the described drawings are only related to some embodiments of the disclosure and thus are not limitative of the disclosure.

DETAILED DESCRIPTION

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the description and the claims of the present application for disclosure, are not intended to indicate any sequence, amount or importance, but distinguish various components. Also, the terms such as "a," "an," etc., are not intended to limit the amount, but indicate the existence of at least one. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

The pixel circuit in an organic light-emitting diode (OLED) display device generally adopts matrix driving mode. OLED display devices are divided into active matrix OLED (AMOLED) display devices and passive matrix OLED (PMOLED) display devices according to whether or not a switch element is introduced in each pixel unit. In an AMOLED, a group of thin-film transistors (TFTs) and at least one storage capacitor are integrated into a pixel circuit of each pixel unit. The current flowing across the OLED is controlled by the drive control of the TFTs and the storage capacitor, and then the OLED can emit light as required.

Figure 1A:
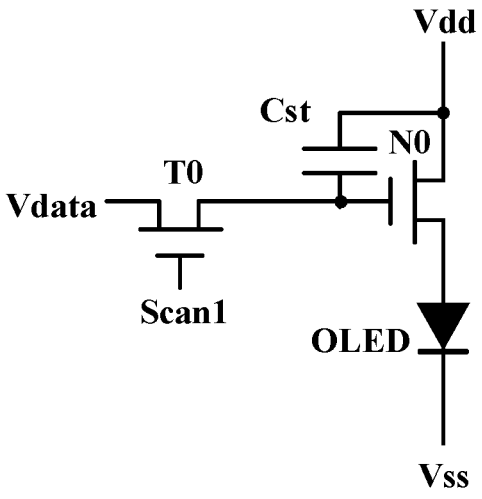
FIG. 1A is a schematic diagram of a pixel circuit.
Figure 1B:
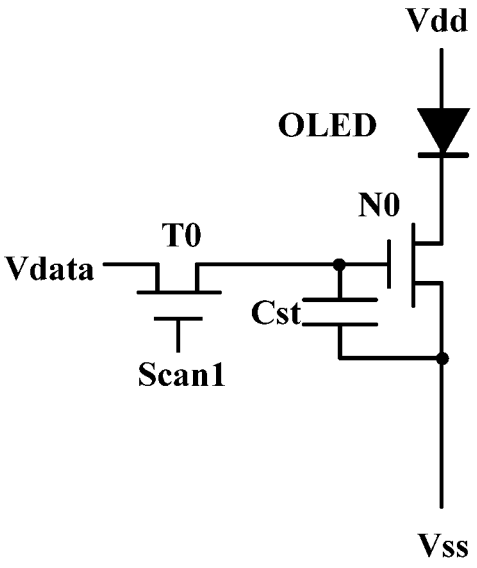
FIG. 1B is a schematic diagram of another pixel circuit.

The basic pixel circuit used in an AMOLED display device is usually a 2T1C pixel circuit, namely the OLED is driven to emit light by utilization of two TFTs and one storage capacitor Cst. FIGS. 1A and 1B are respectively schematic diagrams of two 2T1C pixel circuits.

As shown in FIG. 1A, one 2T1C pixel circuit comprises a switching transistor T0, a driving transistor N0 and a storage capacitor Cst. For instance, a gate electrode of the switching transistor T0 is connected with a scanning line so as to receive a scanning signal Scan1. For instance, a source electrode of the switching transistor T0 is connected to a data line so as to receive a data signal Vdata. A drain electrode of the switching transistor T0 is connected to a gate electrode of the driving transistor N0; a source electrode of the driving transistor N0 is connected to a first voltage terminal so as to receive a first voltage Vdd; a drain electrode of the driving transistor N0 is connected to a positive terminal of the OLED; one end of the storage capacitor Cst is connected to the drain electrode of the switching transistor T0 and the gate electrode of the driving transistor N0; another end of the storage capacitor Cst is connected to the source electrode of the driving transistor N0 and the first voltage terminal; and a negative terminal of the OLED is connected to a second voltage terminal so as to receive second voltage Vss (for instance, the second voltage Vss is less than the first voltage Vdd, and for instance, the second voltage Vss is ground voltage). The 2T1C pixel circuit controls the light and shade (grayscale) of the pixel circuit through two TFTs and the storage capacitor Cst. When the scanning signal Scan1 is applied through the scanning line so as to switch on the switching transistor T0, a data drive circuit charges the storage capacitor Cst via the switching transistor T0 through a data signal Vdata sent by a data line, and then the data signal Vdata is stored in the storage capacitor Cst. And the stored data signal Vdata controls the conduction degree of the driving transistor N0 and then controls the current flowing across the driving transistor and being used for driving the OLED to emit light, namely the current determines the grayscale of light emitted by the pixel unit. In the 2T1C pixel circuit as shown in FIG. 1A, the switching transistor T0 is an N-type transistor, and the driving transistor N0 is a P-type transistor.

As shown in FIG. 1B, another 2T1C pixel circuit also comprises a switching transistor T0, a driving transistor N0 and a storage capacitor Cst, but the connection method has slightly changed, and the driving transistor N0 is an N-type transistor. Compared with the pixel circuit as shown in FIG. 1A, the pixel circuit in FIG. 1B has the following changes: a positive terminal of the OLED is connected to a first voltage terminal so as to receive a first voltage Vdd (high voltage), and a negative terminal is connected to a drain electrode of the driving transistor NO; a source electrode of the driving transistor N0 is connected to a second voltage terminal so as to receive second voltage Vss (low voltage, for instance, ground voltage); one end of the storage capacitor Cst is connected to a drain electrode of the switching transistor T0 and a gate electrode of the driving transistor N0; and the other end of the storage capacitor Cst is connected to the source electrode of the driving transistor N0 and the second voltage terminal. The working mode of the 2T1C pixel circuit is basically the same as that of the pixel circuit as shown in FIG. 1A, so no further description will be given here.

In addition, as for the pixel circuits as shown in FIGS. 1A and 1B, the switching transistor T0 is not limited to be an N-type transistor and may also be a P-type transistor. In this case, the polarity of a scanning signal provided by a scanning control terminal Scan1 for controlling the on or off of the transistor must be correspondingly changed.

An OLED display device generally comprises a plurality of pixel units arranged in an array, and each pixel unit, for instance, may include the foregoing pixel circuit. In the OLED display device, the threshold voltage of the driving transistor in each pixel circuit may be different due to the manufacturing process, and moreover, due to the influence of, for instance, temperature variation, the threshold voltage of the driving transistor may cause drift. As poor display (for instance, uneven display) may be caused due to different threshold voltages of the driving transistors, the threshold voltage are required to be compensated.

For instance, after a data signal (for instance, data voltage) Vdata is applied to the gate electrode of the driving transistor N0 through the switching transistor T0, the data signal Vdata can charge the storage capacitor Cst. Moreover, as the data signal Vdata can switch on the driving transistor N0, the voltage Vs of the source electrode or the drain electrode of the driving transistor N0 electrically connected with one end of the storage capacitor Cst can be correspondingly changed.

Figure 1C:
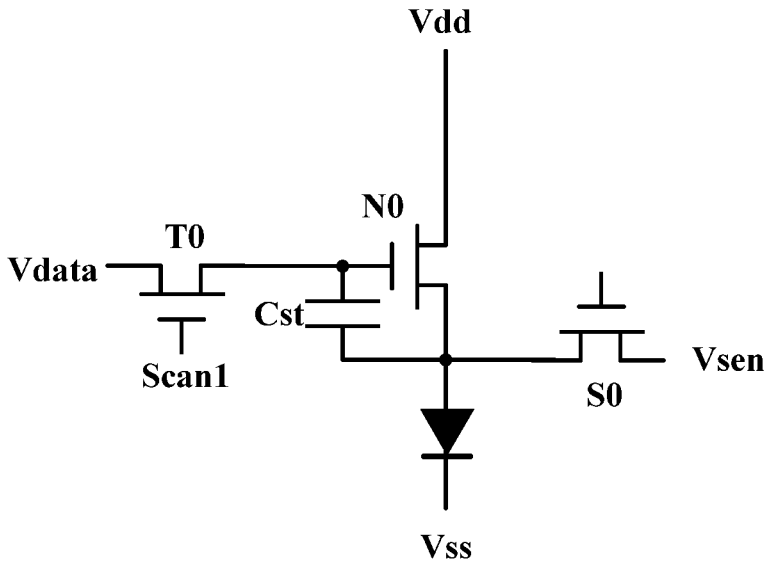
FIG. 1C is a schematic diagram of still another pixel circuit.

For instance, FIG. 1C illustrates a pixel circuit (namely a 3T1C circuit) capable of detecting the threshold voltage of the driving transistor, and the driving transistor N0 is an N-type transistor. For instance, as shown in FIG. 1C, in order to realize the compensation function, a sensing transistor S0 may be introduced on the basis of the 2T1C circuit, that is, a first end of the sensing transistor S0 may be connected to the source electrode of the driving transistor N0 and a second end of the sensing transistor S0 may be connected with a detection circuit (not shown) through a sensing line. Thus, after the driving transistor N0 is switched on, the sensing transistor S0 is adopted to discharge to a detection circuit, so the potential of the source electrode of the driving transistor N0 can change. When the voltage Vs of the source electrode of the driving transistor N0 is equal to the difference between the gate voltage Vg of the driving transistor N0 and the threshold voltage Vth of the driving transistor, the driving transistor N0 is switched off. At this point, after the driving transistor N0 is switched off, the on-state sensing transistor S0 may be adopted to acquire a sensing voltage (namely the voltage Vb of the source electrode after the driving transistor N0 is switched off) from the source electrode of the driving transistor N0. After the voltage Vb of the source electrode after the driving transistor N0 is switched off is acquired, the acquired threshold voltage of the driving transistor can be Vth=Vdata−Vb. Thus, a compensation factor can be created (namely determined) for each pixel circuit on the basis of the threshold voltage of the driving transistor in each pixel circuit, and then the threshold voltage compensation function of each subpixel in the display panel can be realized.

Figure 1D:
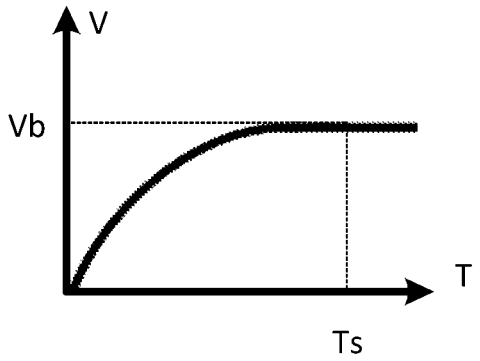
FIG. 1D is a curve diagram illustrating the change of a sensing voltage over time.

For instance, FIG. 1D is a curve diagram illustrating the case where the sensing voltage, acquired from the source electrode of the driving transistor N0 through the on-state sensing transistor S0, changes over time. It has been noted by the inventor that: after the application of the data signal Vdata, in the process of discharging to the detection circuit through the sensing line, the charging speed will be correspondingly reduced (namely the increase speed of the sensing voltage is reduced) along with the increase of the charging time of the storage capacitor Cst and the like (as shown in FIG. 1D), and the reason is that the charging current is reduced along with the increase of the sensing voltage (namely the voltage Vs of the source electrode of the driving transistor N0). Specifically, the current Ids outputted by the driving transistor N0 in the saturated state may be obtained from the following computing formula:

$$\begin{aligned} Ids &= 1/2 \times K(Vg - Vs - Vth)^2 \\ &= 1/2 \times K(Vdata - Vs - Vth)^2 \\ &= 1/2 \times K((Vdata - Vth) - Vs)^2 \end{aligned}$$

Herein, K=W/L×C×μ; W/L refers to the width-to-length ratio (namely the ratio of width to length) of the channel of the driving transistor N0; u refers to the electron mobility; and C refers to the capacitance per unit area.

In the process of the voltage Vs of the source electrode of the driving transistor N0 increasing to Vdata−Vth, [(Vdata−Vth)−Vs] is continuously reduced along with the increase of Vs, and correspondingly, the current Ids outputted by the driving transistor N0 and the charging speed are also continuously reduced along with the voltage. Thus, the time Ts required from the start of charging to the switch-off of the driving transistor N0 is long. Therefore, detection is usually performed in the shutdown process after the display panel ends normal display, and the threshold voltage of the driving transistor N0 cannot be detected during boot-up (for instance, between adjacent display circles in the display process), so real-time monitoring and compensation cannot be realized, and then the compensation effect and the luminance uniformity of the display panel can be degraded.

Embodiments of the present disclosure provide a detection method of a pixel circuit, a driving method of a display panel, and a display device. The detection method can detect the threshold characteristic of the pixel circuit during boot-up and then improve the threshold compensation effect and the luminance uniformity.

At least an embodiment of the present disclosure provides a detection method of a pixel circuit, the pixel circuit includes a driving transistor; and the method comprises: in a first charge cycle, applying a first data voltage to a gate electrode of the driving transistor, acquiring a first sensing voltage at a first electrode of the driving transistor within a first duration after application of the first data voltage and before the driving transistor is switched off, and determining whether the first sensing voltage is equal to a reference sensing voltage, in which the reference sensing voltage is acquired in a reference charge cycle; in the reference charge cycle, the reference sensing voltage is acquired at the first electrode of the driving transistor within the first duration after application of the reference data voltage to the gate electrode of the driving transistor and before the driving transistor is switched off; and the first data voltage is equal to the reference data voltage.

Below in connection with some examples, the detection method of a pixel circuit provided by at least an embodiment of the present disclosure is described in a non-limitative way; as mentioned in the following, without contrary, different technical features of these specific examples can be combined with each other to produce new examples, and these new examples are also in the scope of the present disclosure.

At least an embodiment of the present disclosure provides a detection method of a pixel circuit. The detection method of the pixel circuit can be used for detecting the present threshold voltage Vth of the driving transistor of the pixel circuit. For instance, detailed description will be given below to the detection method of the pixel circuit, provided by at least an embodiment of the present disclosure, with reference to FIGS. 2A-2C.

Figure 4A:
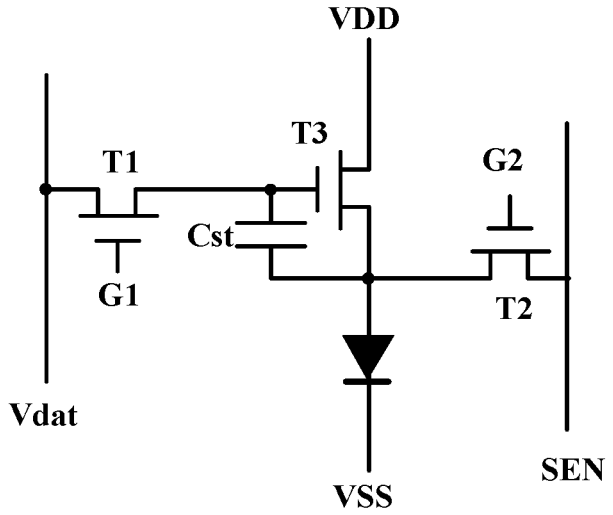
FIG. 4A is a schematic diagram of a pixel circuit provided by at least an embodiment of the present disclosure.
Figure 4B:
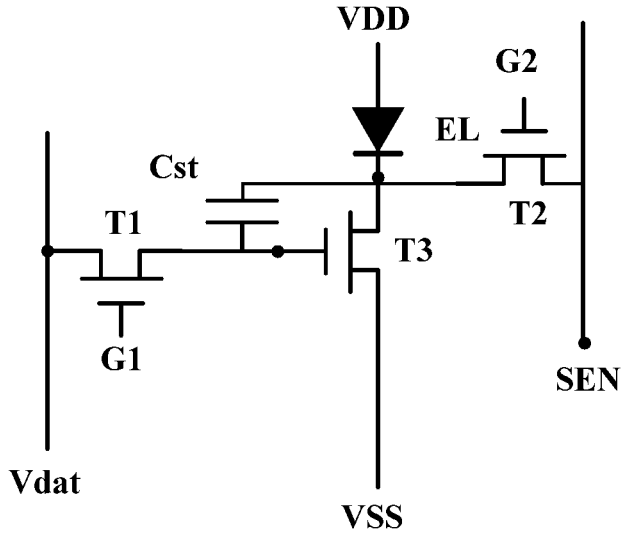
FIG. 4B is a schematic diagram of another pixel circuit provided by at least an embodiment of the present disclosure.

For instance, the pixel circuit may include a driving transistor (for instance, a driving transistor T3 in FIG. 4A or FIG. 4B). For instance, the gate voltage applied to the driving transistor is indicated as DAT. For instance, the detection method of the pixel circuit includes the following step S110.

S110: in a first charge cycle, applying a first data voltage Vd1 to a gate electrode of the driving transistor, acquiring a first sensing voltage Vs1 at a first electrode of the driving transistor within a first duration after the application of the first data voltage Vd1 and before the driving transistor is switched off, and determining whether the first sensing voltage Vs1 is equal to a reference sensing voltage Vsr.

For instance, the reference sensing voltage Vsr is acquired in one reference charge cycle. In the reference charge cycle, the reference sensing voltage Vsr is acquired at the first electrode of the driving transistor within the same first duration after the application of the reference data voltage Vdr to the gate electrode of the driving transistor and before the driving transistor is switched off. For instance, the first data voltage Vd1 is equal to the reference data voltage Vdr.

Figure 2A:
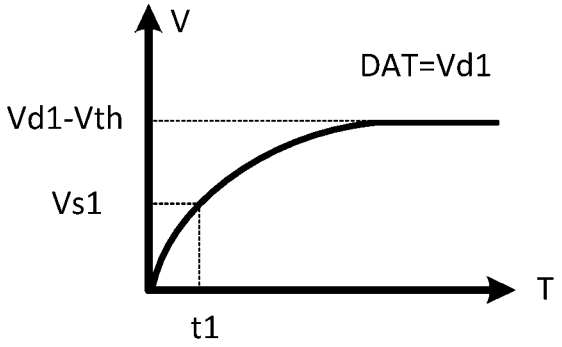
FIG. 2A is a curve diagram illustrating the case where the sensing voltage in a first charge cycle changes over time in at least an embodiment of the present disclosure.

For instance, FIG. 2A shows the case where the voltage (namely the sensing voltage) of the first electrode of the driving transistor in the first charge cycle changes over time. For instance, the first data voltage Vd1 is applied to the gate electrode of the driving transistor starting from the starting moment t0 of the first charge cycle, and subsequently, the first sensing voltage Vs1 is acquired at the first electrode of the driving transistor within the first duration (namely t1−t0) after the application of the first data voltage Vd1. It should be noted that the application of the first data voltage Vd1 to the gate electrode of the driving transistor refers to that the data voltage provided through a data line (for instance, a data line Vdat in FIG. 4A or FIG. 4B) of the pixel circuit is the first data voltage Vd1. Herein, the first electrode of the driving transistor refers to the electrode electrically connected with a sensing switching transistor T2, and may be the source electrode or the drain electrode according to a specific pixel circuit design.

Figure 2B:
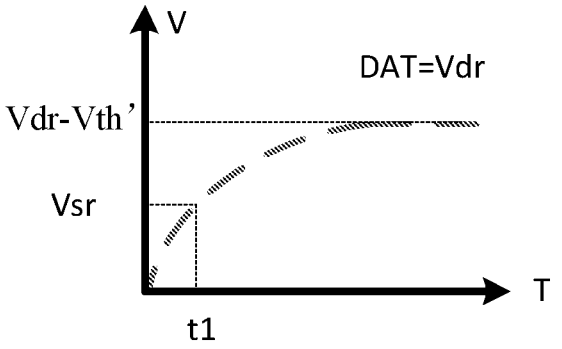
FIG. 2B is a curve diagram illustrating the case where the sensing voltage in a reference charge cycle changes over time in at least an embodiment of the present disclosure.

For instance, FIG. 2B is a curve diagram illustrating the case where the voltage of the first electrode of the driving transistor in the reference charge cycle changes over time. For instance, the reference data voltage Vdr is applied to the gate electrode of the driving transistor starting from the starting moment t0 of the reference charge cycle, and subsequently, the reference sensing voltage Vsr is acquired at the first electrode of the driving transistor within the first duration (namely t1−t0) after the application of the reference data voltage Vdr. It should be noted that the application of the reference data voltage Vdr to the gate electrode of the driving transistor refers to that the voltage provided through the data line of the pixel circuit is the reference data voltage Vdr.

For instance, the reference charge cycle is prior to the first charge cycle. For instance, the reference charge cycle may be in the shutdown state of the corresponding display device in the shutdown process, and the first charge cycle may be in the followed boot-up process of the corresponding display device after the reference charge cycle, namely the startup period or the normal display circle after the boot-up of the corresponding display device. For instance, according to actual application demands, the reference charge cycle may also be in the boot-up state of the corresponding display device during boot-up, namely the startup period after boot-up and before normal display, and the first charge cycle may be in the boot-up process after the reference charge cycle. For instance, the first charge cycle may be between display circles of normal display of the corresponding display device. The display circle can select various appropriate time periods. No specific limitation will be given here.

Figure 2C:
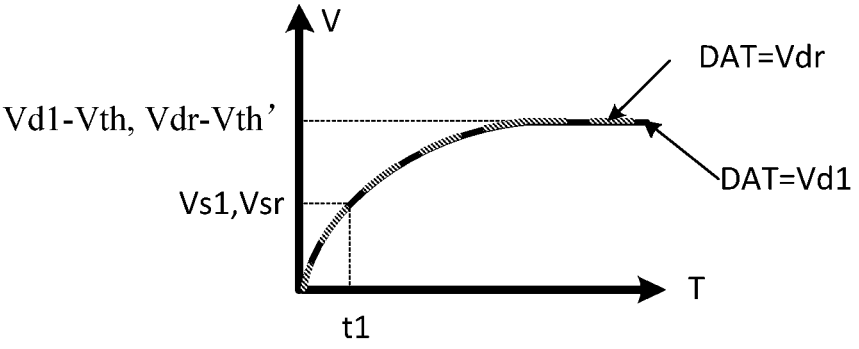
FIG. 2C is a curve diagram illustrating the case where the sensing voltages in a first charge cycle and a reference charge cycle change over time in at least an embodiment of the present disclosure.

For instance, as shown in FIG. 2C, when the first sensing voltage Vs1 is equal to the reference sensing voltage Vsr, the curve that the sensing voltage in the first charge cycle changes over time is equivalent to the curve that the sensing voltage in the reference charge cycle changes over time. Thus, the off sensing voltage Vd1−Vth (i.e., the sensing voltage measured after the driving transistor is switched off) of the first charge cycle is equal to the off sensing voltage Vdr−Vth' of the reference charge cycle, so Vth=Vd1−Vdr+Vth', that is, the present threshold voltage Vth of the pixel circuit is equal to the reference threshold voltage Vth' plus the difference between the first data voltage Vd1 and the reference data voltage Vdr. As the first data voltage Vd1 is equal to the reference data voltage Vdr, the present threshold voltage Vth of the pixel circuit is equal to the reference threshold voltage Vth'. For instance, for clarity, the acquisition method of the reference threshold voltage Vth' will be described below in detail, so no further description will be given here.

Figure 2D:
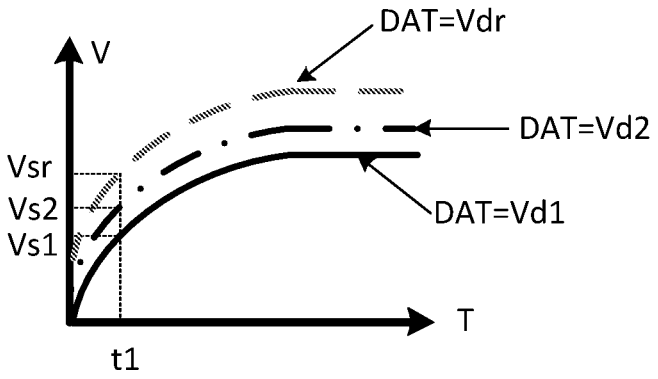
FIG. 2D is a curve diagram illustrating the case where the sensing voltages in a first charge cycle, a reference charge cycle and a second charge cycle change over time in at least an embodiment of the present disclosure.

For instance, as shown in FIG. 2D, when the first sensing voltage Vs1 is unequal to the reference sensing voltage Vsr, the detection method of the pixel circuit may also comprise the following step S120.

S120: in a second charge cycle, applying a second data voltage Vd2 to the gate electrode of the driving transistor, and acquiring a second sensing voltage Vs2 at the first electrode of the driving transistor within the first duration after the application of the second data voltage Vd2.

For instance, FIG. 2D includes a curve diagram illustrating the case where the voltage of the first electrode of the driving transistor in the reference charge cycle changes over time, a curve diagram illustrating the case where the voltage of the first electrode of the driving transistor in the first charge cycle changes over time, and a curve diagram illustrating the case where the voltage of the first electrode of the driving transistor in the second charge cycle changes over time, when the first sensing voltage Vs1 is unequal to the reference sensing voltage Vsr (for instance, the first sensing voltage Vs1 is less than the reference sensing voltage Vsr).

For instance, the second data voltage Vd2 is applied to the gate electrode of the driving transistor starting from the starting moment t0 of the second charge cycle, and subsequently, the second sensing voltage Vs2 is acquired at the first electrode of the driving transistor within the same first duration (namely t1−t0) after the application of the second data voltage Vd2. It should be noted that the application of the second data voltage Vd2 to the gate electrode of the driving transistor refers to that the data voltage provided through the data line of the pixel circuit is the second data voltage Vd2.

For instance, the second charge cycle is between display circles in the boot-up state. For instance, the second charge cycle may be after the first charge cycle. For instance, when the first charge cycle is between the display of the 3rd frame and the display of the 4th frame, the second charge cycle may be in the time slot between the display of the nth frame and the display of the (n+1)th (n is an integer greater than 3) frame, but the embodiments of the present disclosure are not limited thereto.

For instance, as shown in FIG. 2D, the second data voltage Vd2 may be selected so that the difference between the second sensing voltage Vs2 and the reference sensing voltage Vsr can be less than the difference between the first sensing voltage Vs1 and the reference sensing voltage Vsr. It should be noted that the difference between the second sensing voltage Vs2 and the reference sensing voltage Vsr refers to the absolute value of the difference between the second sensing voltage Vs2 and the reference sensing voltage Vsr, namely |Vs2−Vsr|; and the difference between the first sensing voltage Vs1 and the reference sensing voltage Vsr refers to the absolute value of the difference between the first sensing voltage Vs1 and the reference sensing voltage Vsr, namely |Vs1−Vsr|.

For instance, the specific method of selecting the second data voltage Vd2 so that the difference between the second sensing voltage Vs2 and the reference sensing voltage Vsr can be less than the difference between the first sensing voltage Vs1 and the reference sensing voltage Vsr can be set according to actual application demands No specific limitation will be given here in the embodiment of the present disclosure.

For instance, the following method can be adopted to allow the difference |Vs2−Vsr| between the second sensing voltage Vs2 and the reference sensing voltage Vsr to be less than the difference |Vs1−Vsr| between the first sensing voltage Vs1 and the reference sensing voltage Vsr, that is, when the first sensing voltage Vs1 is less than the reference sensing voltage Vsr, the second data voltage Vs2 is allowed to be greater than the value of the first data voltage Vs1; and when the first sensing voltage Vs1 is greater than the reference sensing voltage Vsr, the second data voltage Vs2 is allowed to be less than the value of the first data voltage Vs1.

For instance, as shown in FIG. 2D, in view of the fact that the shape of the charging curve during detection is substantially the same for the same driving transistor, when the first sensing voltage Vs1 is less than the reference sensing voltage Vsr, supposing that the present threshold voltage Vth is fixed, the sensing voltage can be increased by increasing the data voltage. Thus, in the second charge cycle, the second sensing voltage Vs2 can be increased by allowing the second data voltage Vd2 to be greater than the first data voltage Vd1, and then the difference |Vs2−Vsr| between the second sensing voltage Vs2 and the reference sensing voltage Vsr can be less than the difference |Vs1−Vsr| between the first sensing voltage Vs1 and the reference sensing voltage Vsr. Correspondingly, when the first sensing voltage Vs1 is greater than the reference sensing voltage Vsr, the second data voltage Vs2 can be less than the value of the first data voltage Vs1, so that the difference |Vs2−Vsr| between the second sensing voltage Vs2 and the reference sensing voltage Vsr can be less than the difference |Vs1−Vsr| between the first sensing voltage Vs1 and the reference sensing voltage Vsr. No further description will be given to the specific reason.

Figure 2E:
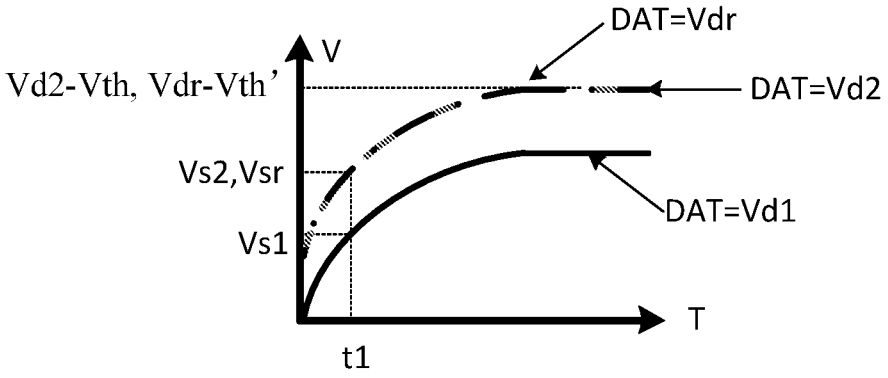
FIG. 2E is another curve diagram illustrating the case where the sensing voltages in a first charge cycle, a reference charge cycle and a second charge cycle change over time in at least an embodiment of the present disclosure.

For instance, as shown in FIG. 2E, when the difference between the second sensing voltage Vs2 and the reference sensing voltage Vsr is equal to zero, namely when the second sensing voltage Vs2 is equal to the reference sensing voltage Vsr, the curve that the sensing voltage of the second charge cycle changes over time is equivalent to the curve that the sensing voltage of the reference charge cycle changes over time. Thus, the off sensing voltage Vd2−Vth (namely the sensing voltage acquired at the first electrode of the driving transistor after the driving transistor is switched off) of the second charge cycle is equal to the off sensing voltage Vdr−Vth' of the reference charge cycle, so Vth=Vd2−Vdr+Vth', that is, the present threshold voltage Vth of the pixel circuit is equal to the reference threshold voltage Vth' plus the difference between the second data voltage Vd2 and the reference data voltage Vdr.

Figure 2F:
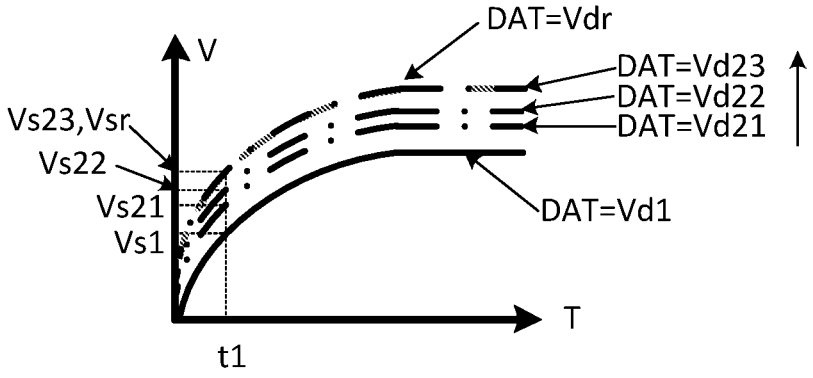
FIG. 2F is still another curve diagram illustrating the case where the sensing voltages in a first charge cycle, a reference charge cycle and a second charge cycle change over time in at least an embodiment of the present disclosure.

For instance, as shown in FIG. 2F, when the second sensing voltage Vs2 is unequal to the reference sensing voltage Vsr, the detection method of the pixel circuit may further comprise the following step S130.

S130: repeating the second charge cycle until the second sensing voltage Vs2 is equal to the reference sensing voltage Vsr.

For instance, the method of successive approximation can be adopted to continuously adjust the applied data voltage until the sensing voltage equal to the reference sensing voltage Vsr is finally obtained. In the above step S130, the repetition of the second charge cycle refers to that in other second charge cycles, the adjusted second data voltage Vd2 (for instance, adjusted from Vd21 to Vd22, from Vd22 to Vd23, etc.) is applied to the gate electrode of the driving transistor, and a new second sensing voltage Vs2 (for instance, when the second data voltage Vd2 is respectively Vd21, Vd22 and Vd23, the second sensing voltage Vs2 is respectively Vs21, Vs22 and Vs23) is acquired at the first electrode of the driving transistor, so as to continuously reduce the difference between the second sensing voltage Vs2 and the reference sensing voltage Vsr|Vs2−Vsr| (for instance, |Vs2−Vsr| is reduced from |Vs21−Vsr| to |Vs22−Vsr|, namely the method of successive approximation is adopted), until the second sensing voltage Vs2 is equal to the reference sensing voltage Vsr (for instance, Vs23=Vsr). Thus, the present threshold voltage Vth (that is, the reference threshold voltage Vth' plus the difference between the finally applied second data voltage Vd2 and the reference data voltage Vdr) of the driving transistor can be acquired on the basis of the reference threshold voltage Vth', the finally applied second data voltage Vd2 and the reference data voltage Vdr.

For instance, in order to accelerate the speed of successive approximation, that is, reduce the frequency of repeating the second charge cycle, the variation ΔVd2 of the second data voltage Vd2 can be determined based on the difference |Vs2−Vsr| between the second sensing voltage Vs2 and the reference sensing voltage Vsr. For instance, ΔVd2=Vd22−Vd21 can be determined based on |Vs21−Vsr|, and then the adjusted second data voltage Vd2 (for instance, Vd22) can be obtained.

For instance, the acquisition method of the reference threshold voltage Vth' can be set according to actual application demands, and no specific limitation will be given here in the embodiment of the present disclosure. For instance, exemplary description will be given below to the acquisition method of the reference threshold voltage Vth' with reference to FIGS. 3A and 3B.

Figure 3A:
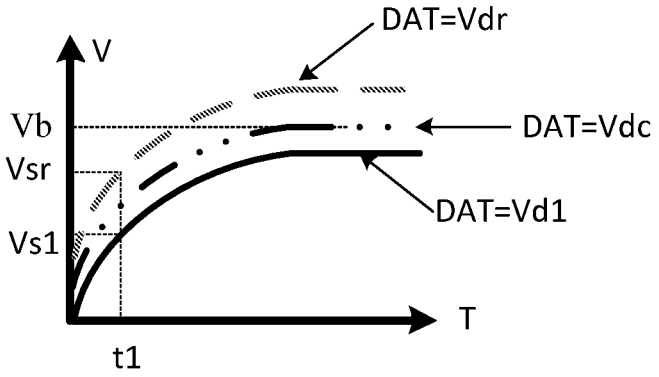
FIG. 3A is a curve diagram illustrating the case where the sensing voltages in a first charge cycle, a reference charge cycle and a shutdown charge cycle change over time in at least an embodiment of the present disclosure.
Figure 3B:
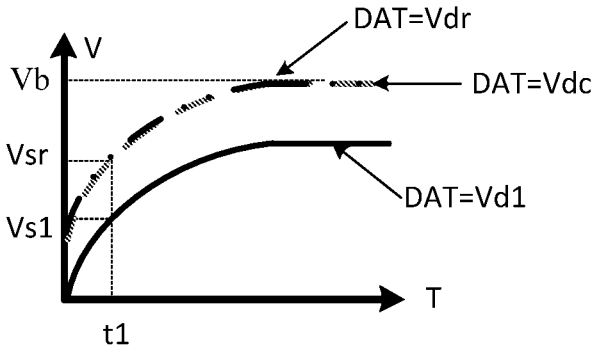
FIG. 3B is another curve diagram illustrating the case where the sensing voltages in a first charge cycle, a reference charge cycle and a shutdown charge cycle change over time in at least an embodiment of the present disclosure.

For instance, as shown in FIGS. 3A and 3B, in the shutdown charge cycle of the shutdown state, shutdown data voltage Vdc is applied to the gate electrode of the driving transistor, and shutdown sensing voltage Vb is acquired at the first electrode of the driving transistor after the driving transistor is switched off. Thus, the reference threshold voltage Vth' is equal to the difference between the shutdown data voltage Vdc and the shutdown sensing voltage Vb, namely Vth'=Vdc−Vb.

For instance, according to actual application demands, the shutdown charge cycle and the reference charge cycle can be different charge cycles, so only the acquired Vth' is stored. For instance, the shutdown data voltage Vdc and the reference data voltage Vdr may be unequal. Moreover, for instance, according to actual application demands, the shutdown data voltage Vdc and the reference data voltage Vdr may also be equal.

For instance, according to actual application demands, the shutdown charge cycle and the reference charge cycle can be the same charge cycle, that is, the detection method may comprise one of the shutdown charge cycle and the reference charge cycle. At this point, the shutdown data voltage Vdc and the reference data voltage Vdr may be equal, so the steps of the detection method of the pixel circuit can be simplified.

For instance, in the detection method of the pixel circuit, provided by at least an embodiment of the present disclosure, as the present threshold voltage Vth can be acquired by the method of comparing the reference sensing voltage Vsr with the first sensing voltage Vs1 obtained within the first duration after the application of the first data voltage Vd1, the sensing voltage (namely the sensing voltage acquired at the first electrode of the driving transistor after the driving transistor is switched off) can be measured without waiting for a long time after the driving transistor is switched off, so the time required for detection (for instance, the detection time of the first charge cycle) can be shortened, and then the present threshold voltage of the driving transistor can be detected during boot-up (for instance, between adjacent display circles, for instance, between adjacent image frames). Therefore, for instance, real-time detection and real-time compensation can be performed in the boot-up process of the display device, and then the compensation effect and the luminance uniformity of the display panel employing the detection method of the pixel circuit can be improved.

At least an embodiment of the present disclosure provides another detection method of the pixel circuit. The detection method of the pixel circuit can be used for detecting the threshold voltage of the driving transistor T3 of the pixel circuit. For instance, another detection method of the pixel circuit, provided by at least an embodiment of the present disclosure, can be used for detecting the threshold voltage of a driving transistor T3 (an N-type driving transistor T3) in the pixel circuit as shown in FIG. 4A, but the embodiments of the present disclosure are not limited thereto. For instance, another detection method of the pixel circuit, provided by at least an embodiment of the present disclosure, can also be used for detecting the threshold voltage of a driving transistor T3 (a P-type driving transistor T3) in the pixel circuit as shown in FIG. 4B. For instance, for clarity, detailed description will be given below to the specific structure of the pixel circuit and the detection method of the pixel circuit by taking the pixel circuit as shown in FIG. 4A as an example, but the embodiments of the present disclosure are not limited thereto.

For instance, as shown in FIG. 4A, the pixel circuit includes a driving transistor T3. For instance, as shown in FIG. 4A, according to actual application demands, the pixel circuit may further include a light-emitting element EL and a sensing switching transistor T2. For instance, the light-emitting element EL may be an OLED, but the embodiments of the present disclosure are not limited thereto. For instance, a second electrode of the driving transistor T3 may be configured to be connected to a first supply voltage terminal VDD, so as to receive a first voltage provided by the first supply voltage terminal VDD, and the first voltage, for instance, may be a constant positive voltage; and a first electrode of the driving transistor T3 may be configured to be connected to a first electrode of the light-emitting element EL.

For instance, as shown in FIG. 4A, a second electrode of the light-emitting element EL is connected to a second supply voltage terminal VSS; the second supply voltage terminal VSS, for instance, can provide a constant voltage; the voltage provided by the second supply voltage terminal VSS can be less than the voltage provided by the first supply voltage terminal VDD; and the second supply voltage terminal VSS, for instance, can be grounded, but the embodiments of the present disclosure are not limited thereto.

For instance, as shown in FIG. 4A, a first electrode (source electrode) of the sensing switching transistor T2 is electrically connected with the first electrode of the driving transistor T3. For instance, as shown in FIG. 2A, the pixel circuit may further include a sensing line SEN; a second electrode of the sensing switching transistor T2 can be electrically connected with the sensing line SEN; and the sensing line SEN is electrically connected with a detection circuit (not shown). For instance, as shown in FIG. 4A, the pixel circuit may further include a data write transistor T1 and a storage capacitor Cst; the data write transistor T1 is configured to write data signals (for instance, a first data voltage and a reference data voltage) into a gate electrode of the driving transistor T3; and the storage capacitor Cst is configured to store the data signals. For instance, the pixel circuit may further include a data line Vdat, and a first end of the data write transistor T1 is connected with the data line Vdat.

For instance, another detection method of the pixel circuit, provided by at least an embodiment of the present disclosure, may comprise the following steps.

S210: in the reference charge cycle, applying a reference data voltage Vdr to the gate electrode of the driving transistor T3, and acquiring a reference sensing voltage Vsr on the first electrode (for instance, the source electrode) of the driving transistor T3 within the first duration after the application of the reference data voltage Vdr to the gate electrode of the driving transistor T3 and before the driving transistor T3 is switched off; and acquiring a sensing voltage Vb at the first electrode of the driving transistor T3 after the driving transistor T3 is switched off.

S220: in the first charge cycle, applying a first data voltage Vd1 to the gate electrode of the driving transistor T3; and acquiring a first sensing voltage Vs1 at the first electrode of the driving transistor T3 within the first duration after the application of the first data voltage Vd1 and before the driving transistor T3 is switched off.

S230: determining whether the first sensing voltage Vs1 is equal to the reference sensing voltage Vsr, and acquiring the present threshold voltage Vth of the driving transistor T3.

Figure 5A:
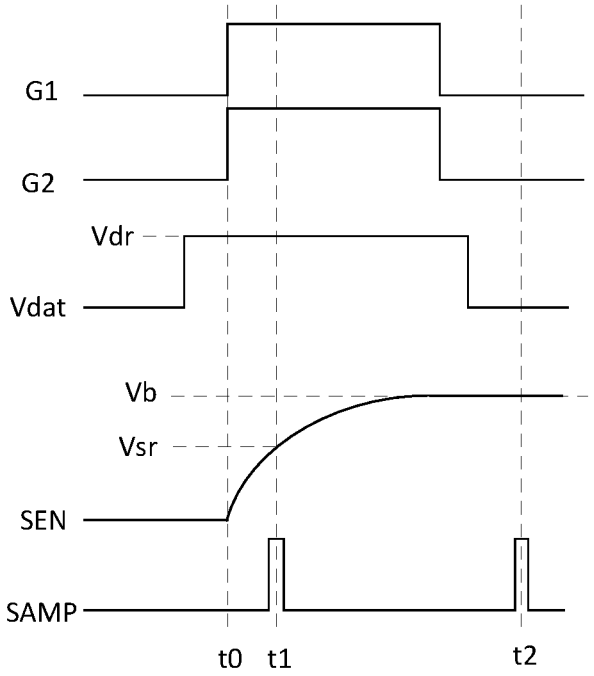
FIG. 5A is a drive timing diagram of the pixel circuit as shown in FIG. 4A in a reference charge cycle and a curve diagram illustrating the change of the sensing voltage over time.

For instance, in another detection method of the pixel circuit, provided by at least an embodiment of the present disclosure, the reference charge cycle can be in the shutdown state. For instance, the above detection method can be executed according to the sequence of the steps S210, S220 and S230. For instance, in the step S210, the data write transistor T1 and the sensing switching transistor T2 can be switched on at first, so the reference data voltage Vdr provided by the data line can charge the storage capacitor Cst through the on-state data write transistor T1, and then the reference data voltage Vdr can be stored in the storage capacitor Cst and applied to the gate electrode of the driving transistor T3. For instance, as shown in FIG. 5A, the data write transistor T1 and the sensing switching transistor T2 can be switched on by applying high level signals to a control terminal G1 of the data write transistor T1 and a control terminal G2 of the sensing switching transistor T2, respectively, but the embodiments of the present disclosure are not limited thereto. For instance, the starting moment t0 of applying the reference data voltage Vdr to the gate electrode of the driving transistor T3 can be the conduction moment of the data write transistor T1.

For instance, after the application of the reference data voltage Vdr to the first electrode of the driving transistor T3, the voltage of the first electrode of the driving transistor T3 is continuously increased over time until the driving transistor T3 is switched off. For instance, FIG. 5A is a curve in which the voltage of the first electrode of the driving transistor T3 in the reference charge cycle changes over time (namely a curve in which the voltage outputted by the sensing line SEN changes over time).

For instance, as shown in FIG. 5A, the reference sensing voltage Vsr and the off sensing voltage Vb can be acquired from the first electrode of the driving transistor T3 through the on-state sensing switching transistor T2 by utilization of a sampling signal SAMP provided by, for instance, a sampling circuit (not shown in the figure) in the detection circuit.

For instance, as shown in FIG. 5A, the first duration after the application of the reference data voltage Vdr can be the difference t1−t0 between the first voltage sampling moment t1 and the starting moment t0 of applying the reference data voltage Vdr. For instance, the first duration can be set according to actual application demands, and no specific limitation will be given here in the embodiment of the present disclosure. For instance, the reference sensing voltage Vsr acquired at the first electrode of the driving transistor T3 can be stored, so that the reference sensing voltage Vsr can be used in the subsequent step S230.

For instance, the second voltage sampling moment can be the t2 moment after the driving transistor T3 is switched off. For instance, the reference threshold voltage Vth' of the driving transistor T3 can be acquired based on the off sensing voltage Vb acquired at the first electrode of the driving transistor T3 and the reference data voltage Vdr applied to the gate electrode of the driving transistor T3. The reference threshold voltage Vth' of the driving transistor T3 satisfies the following expression: Vth'=Vdr−Vb. For instance, the reference threshold voltage Vth' of the driving transistor T3 can be stored, so that the reference threshold voltage Vth' can be used in the subsequent step S230.

Figure 5B:
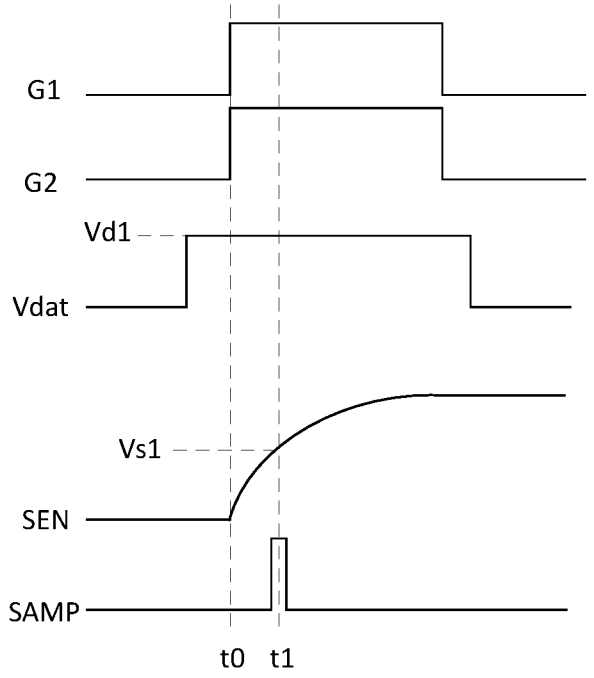
FIG. 5B is a drive timing diagram of the pixel circuit as shown in FIG. 4A in the first charge cycle and a curve diagram illustrating the change of the sensing voltage over time.

For instance, in another detection method of the pixel circuit provided by at least an embodiment of the present disclosure, the first charge cycle can be in the followed boot-up process after the reference charge cycle. For instance, in the step S220, the data write transistor T1 and the sensing switching transistor T2 can be switched on at first, so the first data voltage Vd1 provided by the data line can charge the storage capacitor Cst through the on-state data write transistor T1, and then the first data voltage Vd1 can be stored in the storage capacitor Cst and applied to the gate electrode of the driving transistor T3. For instance, as shown in FIG. 5B, the data write transistor T1 and the sensing switching transistor T2 can be switched on by applying high level signals to the control terminal G1 of the data write transistor T1 and the control terminal G2 of the sensing switching transistor T2, respectively, but the embodiments of the present disclosure are not limited thereto. For instance, the starting moment of applying the first data voltage Vd1 to the gate electrode of the driving transistor T3 can be the conduction moment of the data write transistor T1.

For instance, after the data voltage Vd1 is applied to the first electrode of the driving transistor T3, the voltage of the first electrode of the driving transistor T3 is continuously increased over time until the driving transistor T3 is switched off. For instance, FIG. 5B is a curve in which the voltage of the first electrode of the driving transistor T3 in the first charge cycle changes over time. For instance, as shown in FIG. 5B, the first sensing voltage Vs1 can be acquired from the first electrode of the driving transistor T3 through the on-state sensing switching transistor T2 by utilization of a sampling signal SAMP provided by, for instance, a sampling circuit (not shown in the figure).

It should be noted that: in another detection method of the pixel circuit, provided by at least an embodiment of the present disclosure, as the off sensing voltage of the driving transistor T3 in the first charge cycle cannot be measured, the curve in which the voltage of the first electrode of the driving transistor T3 in the first charge cycle changes over time as shown in FIG. 5B aims to illustrate the variation tendency of the voltage of the first electrode of the driving transistor T3 in the first charge cycle over time, and in actual detection process, detection (for instance, the detection of the first charge cycle) can be ended after the t1 moment, so the curve after the t1 moment may not exist, that is, the duration of the first charge cycle can be greater than the first duration (namely t1−t0) and less than the duration of the reference charge cycle.

For instance, the step of determining whether the first sensing voltage Vs1 is equal to the reference sensing voltage Vsr and acquiring the present threshold voltage Vth of the driving transistor T3 may include the following steps.

S231: determining whether the first sensing voltage Vs1 is equal to the reference sensing voltage Vsr.

S232: acquiring the present threshold voltage Vth of the driving transistor T3.

Figure 5C:
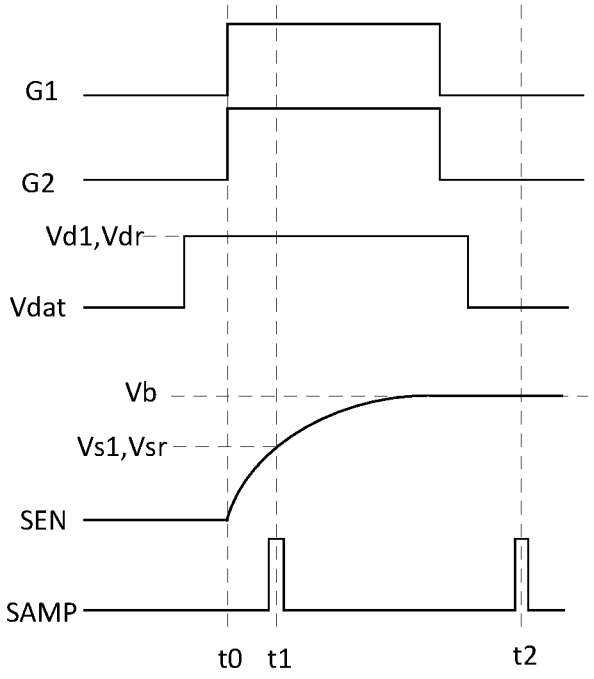
FIG. 5C is a drive timing diagram of the pixel circuit as shown in FIG. 4A in the reference charge cycle and the first charge cycle and a curve diagram illustrating the change of the sensing voltage over time.

For instance, if the first sensing voltage Vs1 is equal to the reference sensing voltage Vsr, the curve in which the sensing voltage in the first charge cycle changes over time is equivalent to the curve in which the sensing voltage in the reference charge cycle changes over time (as shown in FIG. 5C). Thus, the off sensing voltage Vd1−Vth (namely the sensing voltage measured after the driving transistor T3 is switched off) of the first charge cycle is equal to the off sensing voltage Vdr−Vth' of the reference charge cycle, so Vth=Vd1−Vdr+Vth', that is, the present threshold voltage Vth of the pixel circuit is equal to the reference threshold voltage Vth' plus the difference between the first data voltage Vd1 and the reference data voltage Vdr. As the first data voltage Vd1 is equal to the reference data voltage Vdr, the present threshold voltage Vth of the pixel circuit is equal to the reference threshold voltage Vth'.

For instance, the description that the first sensing voltage Vs1 is equal to the reference sensing voltage Vsr may indicate that the first sensing voltage Vs1 is completely equal to the reference sensing voltage Vsr, so the compensation factor created for each pixel circuit can be more accurate. Moreover, for instance, according to actual application demands, the description that the first sensing voltage Vs1 is equal to the reference sensing voltage Vsr may also indicate that the difference between the first sensing voltage Vs1 and the reference sensing voltage Vsr is less than a certain value (for instance, 1% of the mean value of the first sensing voltage Vs1 and the reference sensing voltage Vsr), so the detection time of the pixel circuit can be shortened.

For instance, when the first sensing voltage Vs1 is unequal to the reference sensing voltage Vsr, the method may further comprise the following step S233 before the step of acquiring the present threshold voltage Vth of the driving transistor T3 (namely before executing the step S232).

S233: in the second charge cycle, applying a second data voltage Vd2 to the gate electrode of the driving transistor T3, and acquiring a second sensing voltage Vs2 at the first electrode of the driving transistor T3 within the first duration after the application of the second data voltage Vd2.

Figure 5D:
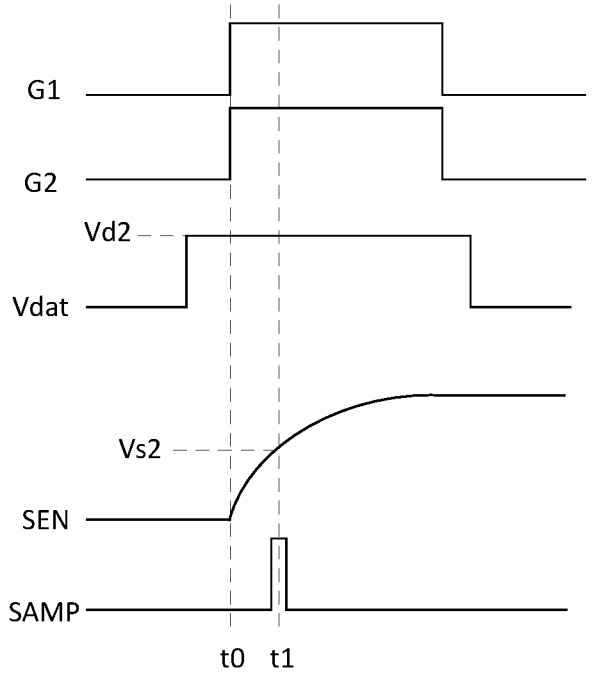
FIG. 5D is a drive timing diagram of the pixel circuit as shown in FIG. 4A in the second charge cycle and a curve diagram illustrating the change of the sensing voltage over time.

For instance, the second charge cycle may be in the boot-up process. For instance, as shown in FIG. 5D, in the step S233, the data write transistor T1 and the sensing switching transistor T2 can be switched on, so the second data voltage Vd2 provided by the data line can charge the storage capacitor Cst through the on-state data write transistor T1, and then the second data voltage Vd2 can be applied to the gate electrode of the driving transistor T3. For instance, the starting moment t0 of applying the second data voltage Vd2 to the gate electrode of the driving transistor T3 can be the conduction moment of the data write transistor T1.

For instance, after the data voltage Vd2 is applied to the first electrode of the driving transistor T3, the voltage of the first electrode of the driving transistor T3 is continuously increased over time until the driving transistor T3 is switched off. For instance, FIG. 5D is a curve in which the voltage of the first electrode of the driving transistor T3 in the second charge cycle changes over time. For instance, as shown in FIG. 5D, the second sensing voltage Vs2 can be acquired from the first electrode of the driving transistor T3 through the on-state sensing switching transistor T2 by utilization of a sampling signal SAMP provided by, for instance, a sampling circuit (not shown in the figure).

It should be noted that: in another detection method of the pixel circuit provided by at least an embodiment of the present disclosure, as the off sensing voltage of the driving transistor T3 in the second charge cycle is not required to be measured, the curve in which the voltage of the first electrode of the driving transistor T3 in the second charge cycle changes over time aims to illustrate the variation tendency of the voltage of the first electrode of the driving transistor T3 in the second charge cycle over time, and in actual detection process, the second charge cycle can be ended after the t1 moment. Thus, the curve after the t1 moment may not exist, namely the duration of the second charge cycle can be greater than the first duration (namely t1−t0) and less than the duration of the reference charge cycle.

For instance, the second data voltage Vd2 can be selected so that the difference between the second sensing voltage Vs2 and the reference sensing voltage Vsr can be less than the difference between the first sensing voltage Vs1 and the reference sensing voltage Vsr. For instance, as shown in FIG. 5E, the second data voltage Vd2 can be selected so that the difference between the second sensing voltage Vs2 and the reference sensing voltage Vsr can be equal to zero.

Figure 5E:
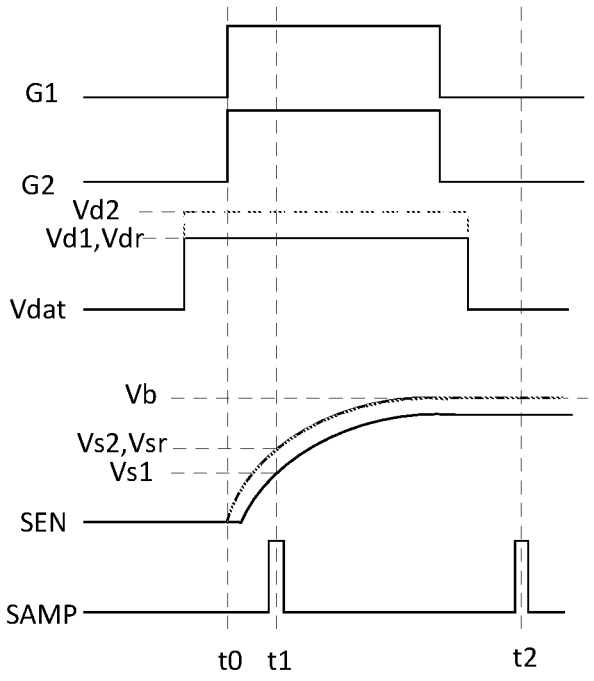
FIG. 5E is a drive timing diagram of the pixel circuit as shown in FIG. 4A in the reference charge cycle, the first charge cycle and the second charge cycle and a curve diagram illustrating the change of the sensing voltage over time.

For instance, as shown in FIG. 5E, when the first sensing voltage Vs1 is less than the reference sensing voltage Vsr, the second data voltage Vd2 can be greater than the value of the first data voltage Vd1 (namely Vd2>Vd1), so Vs2 is greater than Vs1, that is, compared with the first sensing voltage Vs1, the second sensing voltage Vs2 can be closer to the value of the reference sensing voltage Vsr. Thus, the difference |Vs2−Vsr| between the second sensing voltage Vs2 and the reference sensing voltage Vsr can be less than the difference |Vs1−Vsr| between the first sensing voltage Vs1 and the reference sensing voltage Vsr.

For instance, when the first sensing voltage Vs1 is greater than the reference sensing voltage Vsr, the second data voltage Vs2 can be less than the value of the first data voltage Vs1 (namely Vd2<Vd1), so Vs2 is less than Vs1. Thus, the difference |Vs2−Vsr| between the second sensing voltage Vs2 and the reference sensing voltage Vsr can be less than the difference |Vs1−Vsr| between the first sensing voltage Vs1 and the reference sensing voltage Vsr.

For instance, as shown in FIG. 5E, when the difference between the second sensing voltage Vs2 and the reference sensing voltage Vsr is equal to zero, namely when the second sensing voltage Vs2 is equal to the reference sensing voltage Vsr, the curve in which the sensing voltage of the second charge cycle changes over time is equivalent to the curve in which the sensing voltage of the reference charge cycle changes over time. Thus, the off sensing voltage Vd2−Vth (namely the sensing voltage acquired at the first electrode of the driving transistor T3 after the driving transistor T3 is switched off) of the second charge cycle is equal to the off sensing voltage Vdr−Vth' of the reference charge cycle, so Vth=Vd2−Vdr+Vth', that is, the present threshold voltage Vth of the pixel circuit is equal to the reference threshold voltage Vth' plus the difference between the second data voltage Vd2 and the reference data voltage Vdr.

For instance, when the second sensing voltage Vs2 is unequal to the reference sensing voltage Vsr, the method may further comprise the following step S234 before the step of acquiring the present threshold voltage Vth of the driving transistor T3 (namely before executing the step S232).

S234: repeating the second charge cycle until the second sensing voltage Vs2 is equal to the reference sensing voltage Vsr.

For instance, the specific method of repeating the second charge cycle may refer to the detection method of the pixel circuit, provided by at least an embodiment of the present disclosure. No further description will be given herein.

For instance, in another detection method of the pixel circuit, provided by at least an embodiment of the present disclosure, as the present threshold voltage Vth of the pixel circuit can be acquired by comparing the reference sensing voltage Vsr and the first sensing voltage Vs1 acquired within the first duration after the application of the first data voltage Vd1, the off sensing voltage is not required to be measured after the driving transistor T3 is switched off. Thus, the time required for the first charge cycle can be shortened, so the present threshold voltage of the driving transistor T3 can be detected during boot-up (for instance, between adjacent display circles), and then the compensation effect and the luminance uniformity of the display panel, employing the detection method of the pixel circuit, can be improved.

At least an embodiment of the present disclosure provides still another detection method of the pixel circuit. The detection method of the pixel circuit can be used for detecting the threshold voltage of the driving transistor T3 of the pixel circuit. For instance, still another detection method of the pixel circuit, provided by at least an embodiment of the present disclosure, can be used for detecting the threshold voltage of the driving transistor T3 in the pixel circuit as shown in FIG. 4A or FIG. 4B, but the embodiments of the present disclosure are not limited thereto. For instance, the specific description of the pixel circuit may refer to the examples as shown in FIGS. 4A and 4*b*, so no further description will be given here. For instance, for clarity, detailed description will be given below to the detection method of the pixel circuit by taking the pixel circuit as shown in FIG. 4A as an example, but the embodiments of the present disclosure are not limited thereto.

For instance, still another detection method of the pixel circuit, provided by at least an embodiment of the present disclosure, may comprise the following steps.

S310: in the shutdown charge cycle, applying a shutdown data voltage Vdc to the gate electrode of the driving transistor T3; and acquiring an off sensing voltage Vb at the first electrode of the driving transistor T3 after the driving transistor T3 is switched off.

S320: in the reference charge cycle, applying a reference data voltage Vdr to the gate electrode of the driving transistor T3; and acquiring a reference sensing voltage Vsr on the first electrode (for instance, the source electrode) of the driving transistor T3 within the first duration after the application of the reference data voltage Vdr to the gate electrode of the driving transistor T3 and before the driving transistor T3 is switched off.

S330: in the first charge cycle, applying a first data voltage Vd1 to the gate electrode of the driving transistor T3; and acquiring a first sensing voltage Vs1 on the first electrode (for instance, the source electrode) of the driving transistor T3 within the first duration after the application of the first data voltage Vd1 and before the driving transistor T3 is switched off.

The first data voltage Vd1 may be equal to the reference data voltage Vdr.

S340: determining whether the first sensing voltage Vs1 is equal to the reference sensing voltage Vsr, and acquiring the present threshold voltage Vth of the driving transistor T3.

Figure 6A:
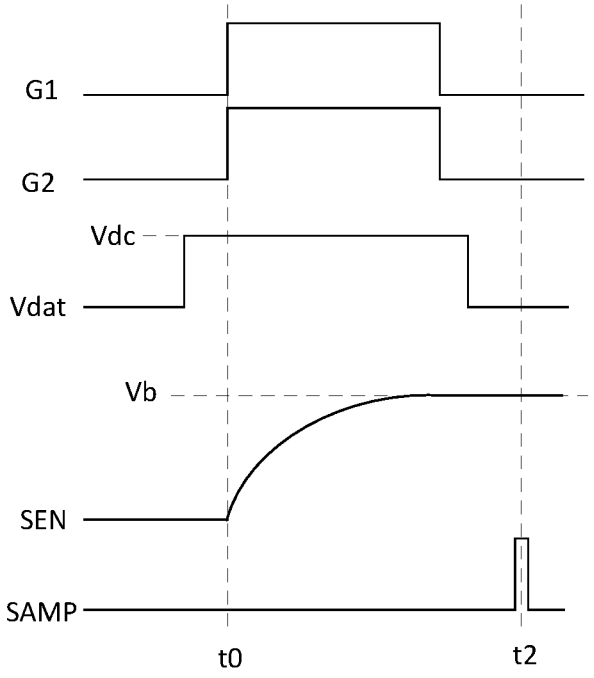
FIG. 6A is a drive timing diagram of the pixel circuit provided by at least an embodiment of the present disclosure in the shutdown charge cycle and a curve diagram illustrating the change of the sensing voltage over time.

For instance, the shutdown charge cycle is in the shutdown state. For instance, as shown in FIG. 6A, in the step S310, the data write transistor T1 and the sensing switching transistor T2 can be switched on, so the shutdown data voltage Vdc provided by the data line can charge the storage capacitor Cst through the on-state data write transistor T1, and then the shutdown data voltage Vdc can be applied to the gate electrode of the driving transistor T3. For instance, the starting moment t0 of applying the shutdown data voltage Vdc to the gate electrode of the driving transistor T3 can be the conduction moment of the data write transistor T1.

For instance, after the shutdown data voltage Vdc is applied to the first electrode of the driving transistor T3, the voltage of the first electrode of the driving transistor T3 is continuously increased over time until the driving transistor T3 is switched off. For instance, FIG. 6A is a curve in which the voltage of the first electrode of the driving transistor T3 in the shutdown charge cycle changes over time (namely a curve in which the voltage outputted by the sensing line SEN changes over time). For instance, as shown in FIG. 6A, the off sensing voltage Vb can be acquired from the first electrode of the driving transistor T3 through the on-state sensing switching transistor T2 by utilization of a sampling signal SAMP provided by, for instance, a sampling circuit (not shown in the figure). For instance, the off sensing voltage Vb (not shown in the figure) can be acquired at the t2 moment after the driving transistor T3 is switched off. For instance, the reference threshold voltage Vth' of the driving transistor T3 can be acquired based on the off sensing voltage Vb acquired at the first electrode of the driving transistor T3 and the shutdown data voltage Vdc applied to the gate electrode of the driving transistor T3, and the reference threshold voltage of the driving transistor T3 is Vth'=Vdc−Vb. For instance, the reference threshold voltage Vth' of the driving transistor T3 can be stored and then used in the subsequent step S340.

For instance, in still another detection method of the pixel circuit, provided by at least an embodiment of the present disclosure, the reference charge cycle may be in the boot-up state. For instance, the reference charge cycle may be at the beginning of display after boot. The reference charge cycle, for instance, may be in the time slot between the display of the first frame and the display of the second frame, but the embodiments of the present disclosure are not limited thereto.

Figure 6B:
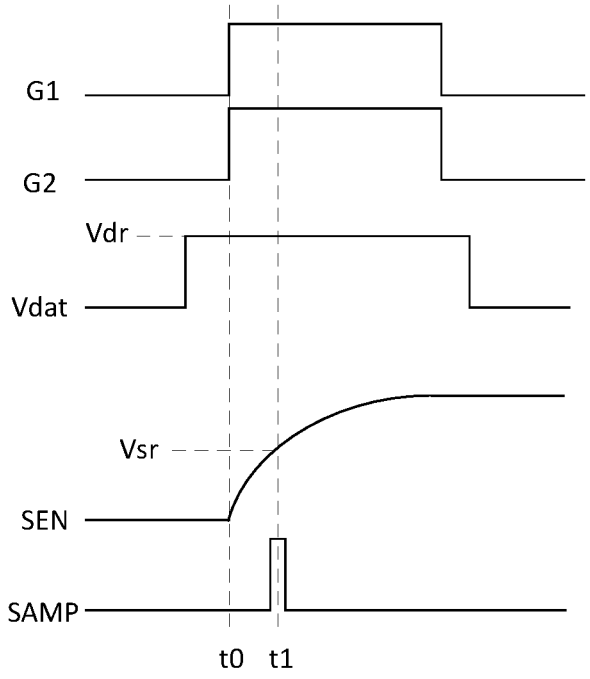
FIG. 6B is a drive timing diagram of the pixel circuit provided by at least an embodiment of the present disclosure in the reference charge cycle and a curve diagram illustrating the change of the sensing voltage over time.

For instance, the reference data voltage Vdr may be set to be Vref+Vth'. The value of Vref may be set according to the specific type of the pixel circuit and actual application demands No specific limitation will be given here in the embodiment of the present disclosure. For instance, in the step S320, after the reference data voltage Vdr is applied to the first electrode of the driving transistor T3, the voltage of the first electrode of the driving transistor T3 is continuously increased over time until the driving transistor T3 is switched off. For instance, FIG. 6B is a curve in which the voltage of the first electrode of the driving transistor T3 in the reference charge cycle changes over time (namely a curve in which the voltage outputted by the sensing line SEN changes over time). For instance, as shown in FIG. 6B, the reference sensing voltage Vsr can be acquired from the first electrode of the driving transistor T3 through the on-state sensing switching transistor T2 by utilization of a sampling signal SAMP provided by, for instance, a sampling circuit (not shown in the figure). For instance, as shown in FIG. 6B, the first duration after the application of the reference data voltage Vdr may be t1−t0. For instance, the reference sensing voltage Vsr acquired from the first electrode of the driving transistor T3 can be stored and then used in the subsequent step S230.

Figure 6C:
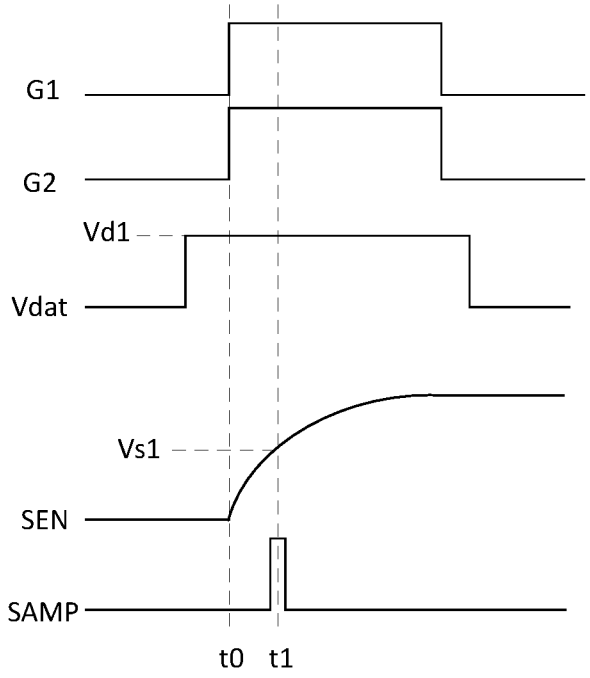
FIG. 6C is a drive timing diagram of the pixel circuit provided by at least an embodiment of the present disclosure in the first charge cycle and a curve diagram illustrating the change of the sensing voltage over time.

For instance, the first charge cycle may be in the boot-up process after the reference charge cycle. For instance, in the step S330, after the data voltage Vd1 (for instance, Vd1=Vref+Vth) is applied to the first electrode of the driving transistor T3, the voltage of the first electrode of the driving transistor T3 is continuously increased over time until the driving transistor T3 is switched off. For instance, FIG. 6C is a curve in which the voltage of the first electrode of the driving transistor T3 in the first charge cycle changes over time. For instance, as shown in FIG. 6C, the first sensing voltage Vs1 can be acquired from the first electrode of the driving transistor T3 through the on-state sensing switching transistor T2 by utilization of a sampling signal SAMP provided by, for instance, a sampling circuit (not shown in the figure).

It should be noted that: in still another detection method of the pixel circuit, provided by at least an embodiment of the present disclosure, as the off sensing voltage of the driving transistor T3 in the reference charge cycle and the first charge cycle is not required to be measured, the curve in which the first electrode of the driving transistor T3 in the reference charge cycle changes over time as shown in FIG. 6B and the curve in which the voltage of the first electrode of the driving transistor T3 in the first charge cycle changes over time as shown in FIG. 6C aim to illustrate the variation tendency of the voltage of the first electrode of the driving transistor T3 in the reference charge cycle and the first charge cycle over time, and in actual detection process, the reference charge cycle and the first charge cycle can be ended after the t1 moment. Thus, the curve after the t1 moment may not exist, that is, the duration of the reference charge cycle and the first charge cycle can be greater than the first duration (namely t1−t0) and less than the duration of the shutdown charge cycle.

For instance, the step of determining whether the first sensing voltage Vs1 is equal to the reference sensing voltage Vsr and acquiring the present threshold voltage Vth of the driving transistor T3 may comprise the following steps.

S341: determining whether the first sensing voltage Vs1 is equal to the reference sensing voltage Vsr.

S342: acquiring the present threshold voltage Vth of the driving transistor T3.

For instance, if the first sensing voltage Vs1 is equal to the reference sensing voltage Vsr, the curve in which the sensing voltage in the first charge cycle changes over time is equivalent to the curve in which the sensing voltage in the reference charge cycle changes over time. Thus, the off sensing voltage Vd1−Vth (namely the sensing voltage measured after the driving transistor T3 is switched off) of the first charge cycle is equal to the off sensing voltage Vdr−Vth' of the reference charge cycle, so Vth=Vd1−Vdr+Vth', that is, the present threshold voltage Vth of the pixel circuit is equal to the reference threshold voltage Vth' plus the difference between the first data voltage Vd1 and the reference data voltage Vdr. As the first data voltage Vd1 is equal to the reference data voltage Vdr, the present threshold voltage Vth of the pixel circuit is equal to the reference threshold voltage Vth'.

For instance, when the first sensing voltage Vs1 is unequal to the reference sensing voltage Vsr, the method may further comprise the following step S343 before the step of acquiring the present threshold voltage Vth of the driving transistor T3 (namely before executing the step S342).

S343: in the second charge cycle, applying a second data voltage Vd2 to the gate electrode of the driving transistor T3, and acquiring a second sensing voltage Vs2 at the first electrode of the driving transistor T3 within the first duration after the application of the second data voltage Vd2.

Figure 6D:
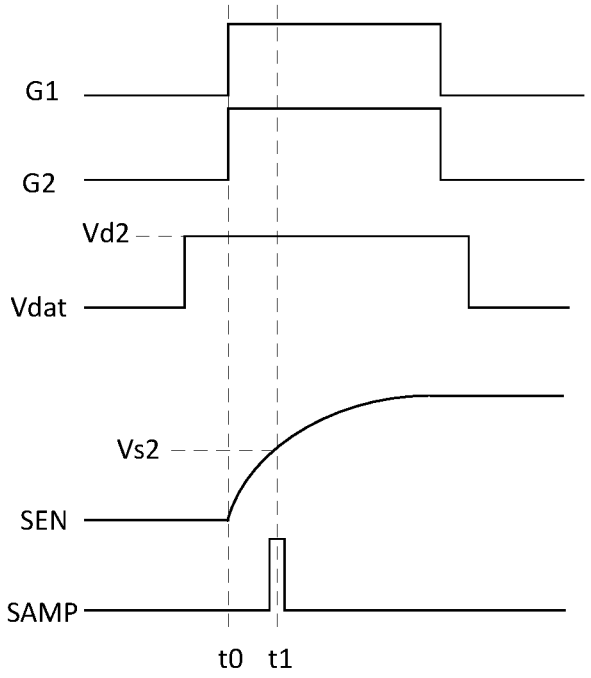
FIG. 6D is a drive timing diagram of the pixel circuit provided by at least an embodiment of the present disclosure in the second charge cycle and a curve diagram illustrating the change of the sensing voltage over time.

For instance, the second charge cycle may be in the boot-up process after the first charge cycle. For instance, as shown in FIG. 6D, in the step S343, after the data voltage Vd2 is applied to the first electrode of the driving transistor T3, the voltage of the first electrode of the driving transistor T3 is continuously increased over time until the driving transistor T3 is switched off. For instance, FIG. 6D is a curve in which the voltage of the first electrode of the driving transistor T3 in the second charge cycle changes over time. For instance, as shown in FIG. 6D, the second sensing voltage Vs2 can be acquired from the first electrode of the driving transistor T3 through the on-state sensing switching transistor T2 by utilization of a sampling signal SAMP provided by, for instance, a sampling circuit (not shown in the figure).

For instance, the second data voltage Vd2 can be selected so that the difference between the second sensing voltage Vs2 and the reference sensing voltage Vsr can be less than the difference between the first sensing voltage Vs1 and the reference sensing voltage Vsr.

For instance, the second data voltage Vd2 can be selected so that the difference between the second sensing voltage Vs2 and the reference sensing voltage Vsr can be equal to zero. For instance, when the difference between the second sensing voltage Vs2 and the reference sensing voltage Vsr is equal to zero, the present threshold voltage Vth of the pixel circuit is equal to the reference threshold voltage Vth' plus the difference between the second sensing voltage Vs2 and the reference sensing voltage Vsr, namely Vth=Vd2−Vdr+Vth'.

For instance, when the second sensing voltage Vs2 is unequal to the reference sensing voltage Vsr, the method may further comprise the following step S344 before the step of acquiring the present threshold voltage Vth of the driving transistor T3 (namely before executing the step S342).

S344: repeating the second charge cycle until the second sensing voltage Vs2 is equal to the reference sensing voltage Vsr.

For instance, the specific method of selecting the second data voltage Vd2 and repeating the second charge cycle may refer to the foregoing detection method of the pixel circuit, so no further description will be given here.

For instance, in still another detection method of the pixel circuit, provided by at least an embodiment of the present disclosure, as the present threshold voltage Vth of the pixel circuit can be acquired by comparing the reference sensing voltage Vsr and the first sensing voltage Vs1 acquired within the first duration after the application of the first data voltage Vd1, the off sensing voltage is not required to be measured after the driving transistor T3 is switched off. Thus, the time required for the first charge cycle can be shortened, so the present threshold voltage of the driving transistor T3 can be detected during boot-up (for instance, between adjacent display circles), and then the compensation effect and the luminance uniformity of the display panel, employing the detection method of the pixel circuit, can be improved.

At least an embodiment of the present disclosure provides still another detection method of the pixel circuit.

Figure 7:
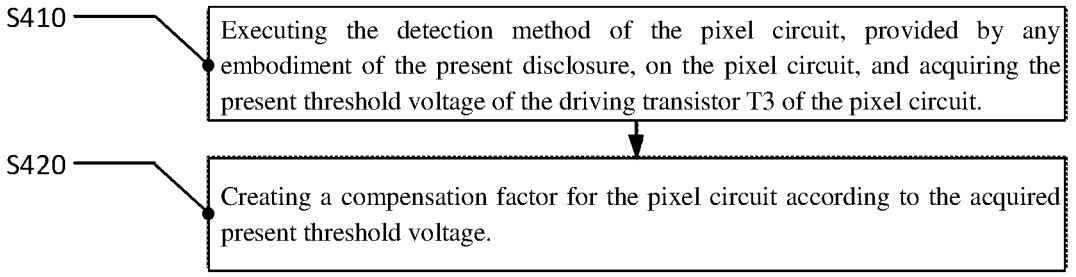
FIG. 7 is a schematic flowchart of a driving method of a display panel, provided by at least an embodiment of the present disclosure.

At least an embodiment of the present disclosure further provides a driving method of a display panel. For instance, the display panel may include pixel circuits, and the pixel circuits in the display panel, for instance, may be arranged in an array. For instance, the pixel circuit in the display panel can be the pixel circuit as shown in FIG. 4A or FIG. 4B. For instance, as shown in FIG. 7, the driving method of the display panel, provided by at least an embodiment of the present disclosure, comprises the step S410.

S410: executing the detection method of the pixel circuit, provided by any embodiment of the present disclosure, on the pixel circuit, and acquiring the present threshold voltage of the driving transistor T3 of the pixel circuit.

For instance, the detection method of the pixel circuit may refer to the foregoing detection method of the pixel circuit. No further description will be given here. For instance, according to actual application demands, the driving method of the display panel, provided by at least an embodiment of the present disclosure, further comprises the step S420.

S420: creating a compensation factor for the pixel circuit according to the acquired present threshold voltage.

For instance, in one example, the present threshold voltage of the driving transistor T3 of the pixel circuit can be detected row by row at first, and subsequently, after acquiring the threshold voltage of the driving transistors T3 of all the pixel circuits in the display panel, a compensation factor can be created for each pixel circuit, and finally, threshold compensation is executed on the display panel based on the created compensation factor, so the threshold compensation of one cycle can be completed. For instance, firstly, the detection method of the pixel circuit provided by any embodiment of the present disclosure can be executed on the pixel circuits disposed in the first row, and the present threshold voltage of the driving transistors T3 of the pixel circuits disposed in the first row is acquired; secondly, the detection method of the pixel circuit provided by any embodiment of the present disclosure can be executed on the pixel circuits disposed in the second row, and the present threshold voltage of the driving transistors T3 of the pixel circuits disposed in the second row is acquired; thirdly, row-by-row detection can be performed on the pixel circuits disposed in other rows of the display panel, until the threshold voltage of the driving transistors T3 of all the pixel circuits in the display panel is acquired; and finally, a compensation factor is created for each pixel circuit, and threshold compensation is performed on the display panel.

For instance, in another example, according to actual application demands, a compensation factor can also be created for each pixel circuit in this row after detecting the acquired present threshold voltage of the driving transistors T3 of the pixel circuits in one row, and subsequently, threshold compensation is performed on the pixel circuits disposed in this row. For instance, firstly, the detection of the current threshold, the creation of a compensation factor, and the threshold compensation can be performed on the pixel circuits in the first row; secondly, the detection of the current threshold, the creation of a compensation factor, and the threshold compensation can be performed on the pixel circuits in the fifth row; thirdly, the detection of the current threshold, the creation of a compensation factor, and the threshold compensation can be performed on the pixel circuits in the second row, until the detection of the current threshold, the creation of a compensation factor, and the threshold compensation are performed on all the pixel circuits in the display panel; and then the threshold compensation of one cycle on the display panel can be realized.

It should be noted that: it should be understood by those skilled in the art that other necessary steps of the driving method of the display panel may refer to the conventional driving method of the display panel, so no further description will be given here.

For instance, the driving method of the display panel provided by at least an embodiment of the present disclosure can detect the present threshold voltage of the driving transistor T3 during boot-up (for instance, between adjacent display circles), realize real-time compensation, and then improve the compensation effect and the luminance uniformity of the display panel employing the driving method.

At least an embodiment of the present disclosure further provides a display device, which comprises a pixel circuit and a control circuit 120. The pixel circuit may be the pixel circuit as shown in FIG. 4A or FIG. 4B. For instance, detailed description will be given below to the display device provided by at least an embodiment of the present disclosure by taking the case where the pixel circuit in the display device provided by at least an embodiment of the present disclosure is the pixel circuit as shown in FIG. 4A as an example, but the embodiments of the present disclosure are not limited thereto.

Figure 8:
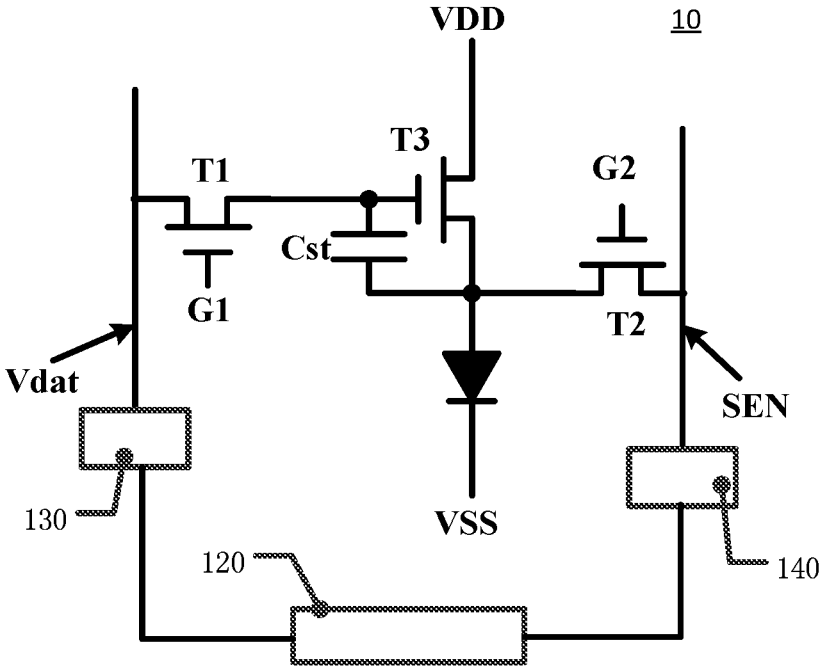
FIG. 8 is an illustrative structural view of a display device provided by at least an embodiment of the present disclosure.

For instance, FIG. 8 is a schematic diagram of a display device provided by at least an embodiment of the present disclosure. For instance, as shown in FIG. 8, the display device comprises a pixel circuit and a control circuit 120, and the pixel circuit includes a driving transistor T3. For instance, the control circuit 120 is configured to execute a detection method comprising:

S510: in the first cycle, applying a first data voltage to a gate electrode of the driving transistor T3, acquiring a first sensing voltage at a first electrode of the driving transistor T3 within the first duration after the application of the first data voltage and before the driving transistor is switched off, and determining whether the first sensing voltage is equal to the reference sensing voltage.

For instance, the reference sensing voltage is acquired in the reference charge cycle. In the reference charge cycle, the reference sensing voltage is acquired at the first electrode of the driving transistor T3 within the first duration after the application of the reference data voltage on the gate electrode of the driving transistor T3 and before the driving transistor T3 is switched off, and the first data voltage is equal to the reference data voltage.

For instance, the specific implementation of the detection method may refer to the detection method of the pixel circuit and the driving method of the display panel, provided by at least an embodiment of the present disclosure. No further description will be given here.

For instance, the display device may further comprise a data drive circuit 130, a detection circuit 140 and a scanning drive circuit (not shown). For instance, the control circuit 120 is further configured to control the data drive circuit 130 and the detection circuit 140. For instance, the data drive circuit 130 is configured to provide the first data voltage and the reference data voltage at different moments according to actual application demands. The scanning drive circuit is configured to provide scanning signals for a data write transistor and a sensing transistor, so as to control the on and off of the data write transistor and the sensing transistor. For instance, the pixel circuit is further configured to receive the first data voltage and the reference data voltage and apply the first data voltage and the reference data voltage to the gate electrode of the driving transistor T3. For instance, the detection circuit 140 is configured to read the first sensing voltage and the reference sensing voltage from the first electrode of the driving transistor T3. For instance, according to actual application demands, the data drive circuit 130 may also be configured to provide shutdown data voltage; the pixel circuit may also be configured to receive the shutdown data voltage and apply the shutdown data voltage to the gate electrode of the driving transistor; and the detection circuit 140 may also be configured to read off sensing voltage from the first electrode of the driving transistor T3.

For instance, the pixel circuit may further include a light-emitting element EL and a sensing switching transistor T2. The light-emitting element EL, for instance, may be an OLED, but the embodiments of the present disclosure are not limited thereto. For instance, a second electrode and the first electrode of the driving transistor T3 may be configured to be respectively connected to a first supply voltage terminal VDD and a first electrode of the light-emitting element EL, and a second electrode of the light-emitting element EL is connected to a second supply voltage terminal VSS. For instance, a first electrode of the sensing switching transistor T2 is electrically connected with the first electrode of the driving transistor T3, and a second electrode of the sensing switching transistor T2 is electrically connected with the detection circuit 140. For instance, the pixel circuit further includes a sensing line SEN. The second electrode of the sensing switching transistor T2 is electrically connected with the detection circuit 140 through the sensing line SEN.

For instance, the pixel circuit further includes a data write transistor T1 and a storage capacitor Cst; the data write transistor T1 is configured to acquire data signals from the data drive circuit 130 and write the data signals into the gate electrode of the driving transistor T3; and the storage capacitor Cst is configured to store the data signals. For instance, the pixel circuit may further include at least partial data line Vdat, and a first electrode of the data write transistor T1 is connected to the data line Vdat.

For instance, the control circuit 120 may further include a processor (not shown in the figure) and a memory (not shown in the figure); the memory includes executable codes; and the processor runs the executable codes so as to execute the detection method provided by any embodiment of the present disclosure.

For instance, the processor is, for example, a central processing unit (CPU) or other forms of processing units having data processing capability and/or instruction execution capability. For example, the processor may be implemented as a general purpose processor, and may also be a microcontroller, a microprocessor, a digital signal processor (DSP), a dedicated image processing chip or a field programmable logic array (FPLA). The memory, for example, may include volatile memory and/or non-volatile memory, and, for example, may include a read only memory (ROM), a hard disk, a flash memory, etc. Accordingly, the memory can be implemented as one or more computer program products. The computer program product may include various forms of computer readable storage media. One or more executable codes (for example, computer program instructions) can be stored on the computer readable storage medium. The processor can run the program instruction to execute the detection method provided by any embodiment of the present disclosure. Thus, the present threshold voltage of the driving transistor of the pixel circuit in the display device can be acquired, and then the threshold compensation function of the display device can be realized. For example, the memory can also store various other applications and various data, e.g., the reference threshold voltage and/or the present threshold voltage of each pixel circuit, as well as various data used and/or generated by the applications.

For instance, the display device provided by at least an embodiment of the present disclosure can detect the present threshold voltage of the driving transistor during boot-up (for instance, between adjacent display circles), execute real-time detection and real-time compensation during boot-up of the display device, and improve the compensation effect and the luminance uniformity of the display device.

It is apparent that the presented disclosure may be changed and modified by those skilled in the art without departure from the spirit and scope of the disclosure, if the above-mentioned changes and modifications of the presented disclosure belong to the scope of the claims of the presented disclosure and its equivalent technologies, the presented disclosure is intended to include the above changes and modifications.

What are described above is related to the illustrative embodiments of the disclosure only and not limitative to the scope of the disclosure; the scopes of the disclosure are defined by the accompanying claims.

What is claimed is:

1. A detection method of a pixel circuit, wherein the pixel circuit includes a driving transistor; and the method comprises:

in a first charge cycle, applying a first data voltage to a gate electrode of the driving transistor, acquiring a first sensing voltage at a first electrode of the driving transistor within a first duration after application of the first data voltage and before the driving transistor is switched off, and determining whether the first sensing voltage is equal to a reference sensing voltage, wherein the reference sensing voltage is acquired in a reference charge cycle; in the reference charge cycle, the reference sensing voltage is acquired at the first electrode of the driving transistor within the first duration after application of a reference data voltage to the gate electrode of the driving transistor and before the driving transistor is switched off; and the first data voltage is equal to the reference data voltage, wherein the reference charge cycle is in a shutdown state, and the first charge cycle is in a followed boot-up process after the reference charge cycle; or the reference charge cycle is in a boot-up state, and the first charge cycle is in a boot-up process after the reference charge cycle.

2. The detection method according to claim 1, wherein in a case where the first sensing voltage is unequal to the reference sensing voltage, in a second charge cycle, a second data voltage is applied to the gate electrode of the driving transistor, and a second sensing voltage is acquired at the first electrode of the driving transistor within the first duration after application of the second data voltage, in which the second data voltage is selected so that a difference between the second sensing voltage and the reference sensing voltage can be less than a difference between the first sensing voltage and the reference sensing voltage.

3. The detection method according to claim 2, wherein in a case where the first sensing voltage is less than the reference sensing voltage, the second data voltage is greater than the first data voltage; and in a case where the first sensing voltage is greater than the reference sensing voltage, the second data voltage is less than the first data voltage.

4. The detection method according to claim 2, wherein in a case where the second sensing voltage is still unequal to the reference sensing voltage, the second charge cycle is repeated until the second sensing voltage is equal to the reference sensing voltage.

5. The detection method according to claim 2, wherein the first charge cycle and/or the second charge cycle is between display circles.

6. The detection method according to claim 2, further comprising:

acquiring a reference threshold voltage of the driving transistor; and in a case where the second sensing voltage is equal to the reference sensing voltage, acquiring a present threshold voltage of the driving transistor, based on the reference threshold voltage, the second data voltage and the reference data voltage, wherein the present threshold voltage of the driving transistor is equal to the reference threshold voltage plus a difference between the second data voltage and the reference data voltage.

7. The detection method according to claim 6, wherein acquiring the reference threshold voltage of the driving transistor comprises:

in a shutdown charge cycle of the shutdown state, applying a shutdown data voltage to the gate electrode of the driving transistor, and acquiring a shutdown sensing voltage at the first electrode of the driving transistor after the driving transistor is switched off, in which the reference threshold voltage of the driving transistor is equal to the difference between the shutdown data voltage and the shutdown sensing voltage.

8. The detection method according to claim 7, wherein the shutdown charge cycle is the same as the reference charge cycle, and the shutdown data voltage is equal to the reference data voltage.

9. The detection method according to claim 1, further comprising:

acquiring a reference threshold voltage of the driving transistor; and in a case where the first sensing voltage is equal to the reference sensing voltage, acquiring a present threshold voltage of the driving transistor, based on the reference threshold voltage, the first data voltage and the reference data voltage, wherein the present threshold voltage of the driving transistor is equal to the reference threshold voltage plus a difference between the first data voltage and the reference data voltage.

10. The detection method according to claim 9, wherein acquiring the reference threshold voltage of the driving transistor comprises:

in a shutdown charge cycle of the shutdown state, applying a shutdown data voltage to the gate electrode of the driving transistor, and acquiring a shutdown sensing voltage at the first electrode of the driving transistor after the driving transistor is switched off, in which the reference threshold voltage of the driving transistor is equal to the difference between the shutdown data voltage and the shutdown sensing voltage.

11. The detection method according to claim 10, wherein the shutdown charge cycle is the same as the reference charge cycle, and the shutdown data voltage is equal to the reference data voltage.

12. A driving method of a display panel, wherein the display panel includes a pixel circuit; and the driving method comprises:

acquiring a present threshold voltage of the driving transistor of the pixel circuit by executing the detection method of the pixel circuit according to claim 1 on the pixel circuit.

13. The driving method of the display panel according to claim 12, further comprising:

creating a compensation factor for the pixel circuit according to the acquired present threshold voltage.

14. A display device, comprising a pixel circuit and a control circuit, wherein the pixel circuit includes a driving transistor; and the control circuit is configured to execute a detection method comprising:

in a first charge cycle, applying a first data voltage to a gate electrode of the driving transistor, acquiring a first sensing voltage at a first electrode of the driving transistor within a first duration after application of the first data voltage and before the driving transistor is switched off, and determining whether the first sensing voltage is equal to the reference sensing voltage, in which the reference sensing voltage is acquired in a reference charge cycle; in the reference charge cycle, the reference sensing voltage is acquired at the first electrode of the driving transistor within the first duration after the application of a reference data voltage to the gate electrode of the driving transistor and before the driving transistor is switched off; and the first data voltage is equal to the reference data voltage, wherein the reference charge cycle is in a shutdown state, and the first charge cycle is in a followed boot-up process after the reference charge cycle; or the reference charge cycle is in a boot-up state, and the first charge cycle is in a boot-up process after the reference charge cycle.

15. The display device according to claim 14, further comprising a data drive circuit and a detection circuit, wherein the data drive circuit is configured to output the first data voltage and the reference data voltage; the pixel circuit is further configured to receive the first data voltage and the reference data voltage and apply the first data voltage and the reference data voltage to the gate electrode of the driving transistor;

the detection circuit is configured to read the first sensing voltage and the reference sensing voltage from the first electrode of the driving transistor; and the control circuit is further configured to control the data drive circuit and the detection circuit.

16. The display device according to claim 15, wherein the pixel circuit further includes a data write transistor and a storage capacitor;

the data write transistor is configured to acquire data signals from the data drive circuit and write the data signals into the gate electrode of the driving transistor; and the storage capacitor is configured to store the data signals.

17. The display device according to claim 14, wherein the pixel circuit further includes a light-emitting element and a sensing switching transistor;

a second electrode and the first electrode of the driving transistor are respectively connected to a first supply voltage terminal and a first electrode of the light-emitting element;

a second electrode of the light-emitting element is connected to a second supply voltage terminal;

a first electrode of the sensing switching transistor is electrically connected with the first electrode of the driving transistor; and a second electrode of the sensing switching transistor is electrically connected with the detection circuit.

18. The display device according to claim 17, wherein the pixel circuit further includes a sensing line; and a second electrode of the sensing switching transistor is electrically connected with the detection circuit through the sensing line.

19. The display device according to claim 14, wherein the control circuit includes a processor and a memory;

the memory includes executable codes; and the processor runs the executable codes so as to execute the detection method.

* * * * *